US009344783B2

(12) United States Patent
Clements et al.

(10) Patent No.: US 9,344,783 B2
(45) Date of Patent: May 17, 2016

(54) INVERSE HORN LOUDSPEAKERS

(71) Applicants: Philip R. Clements, Tempe, AZ (US); Boaz Shalev, Needham, MA (US); James Joseph Croft, III, Bellevue, WA (US)

(72) Inventors: Philip R. Clements, Tempe, AZ (US); Boaz Shalev, Needham, MA (US); James Joseph Croft, III, Bellevue, WA (US)

( * ) Notice: Subject to any disclaimer, the term of this patent is extended or adjusted under 35 U.S.C. 154(b) by 0 days.

(21) Appl. No.: 14/303,436

(22) Filed: Jun. 12, 2014

(65) Prior Publication Data

US 2015/0003657 A1 Jan. 1, 2015

Related U.S. Application Data

(63) Continuation of application No. 13/316,793, filed on Dec. 12, 2011, now Pat. No. 8,781,145, which is a continuation of application No. 12/877,950, filed on Sep. 8, 2010, now Pat. No. 8,094,855.

(60) Provisional application No. 61/240,589, filed on Sep. 8, 2009.

(51) Int. Cl.

| | |
|---|---|
| ***H04R 1/02*** | (2006.01) |
| *H04R 1/28* | (2006.01) |
| *H04R 1/34* | (2006.01) |

(52) U.S. Cl.

CPC ..... *H04R 1/02* (2013.01); *H04R 1/2888* (2013.01); *H04R 1/2857* (2013.01); *H04R 1/2861* (2013.01); *H04R 1/2865* (2013.01); *H04R 1/345* (2013.01); *H04R 2440/03* (2013.01)

(58) Field of Classification Search

CPC .... H04R 1/345; H04R 1/2857; H04R 1/2861; H04R 1/2865

See application file for complete search history.

(56) References Cited

U.S. PATENT DOCUMENTS

| | | | | | |
|---|---|---|---|---|---|
| 2,822,883 | A * | 2/1958 | Allison | H04R 1/2857 | 181/199 |
| 3,327,808 | A * | 6/1967 | Shaper | H04R 1/2857 | 181/153 |
| 3,923,123 | A * | 12/1975 | Latimer-Sayer | H04R 1/2857 | 181/144 |
| 5,373,564 | A * | 12/1994 | Spear | H04R 1/2857 | 181/156 |
| 5,714,721 | A * | 2/1998 | Gawronski | H04R 1/2849 | 181/145 |
| 6,771,787 | B1 * | 8/2004 | Hoefler | H04R 1/2857 | 181/145 |
| 7,426,280 | B2 * | 9/2008 | Aylward | H04R 1/2857 | 381/337 |
| 8,031,895 | B2 * | 10/2011 | Schultz | H04R 1/2857 | 381/345 |

* cited by examiner

*Primary Examiner* — Curtis Kuntz
*Assistant Examiner* — Ryan Robinson
(74) *Attorney, Agent, or Firm* — Fenwick & West LLP

(57) ABSTRACT

In a low frequency transducer system a multi-compression chamber, an inverse horn structure is employed in combination with a resonance-distortion filter chamber. The filter chamber effectively expands the effective enclosure volume at low frequencies and connected to one of the compression chambers filter parasitic resonances and distortion and allowing the system to more efficiently reproduce low frequencies while being able to use smaller diameter transducers and maintaining good system sensitivity. Compression chambers are organized for constant or continuous compression on a section-by-section basis throughout the inverse horn system.

24 Claims, 15 Drawing Sheets

Top-down cutaway

FIG. 3
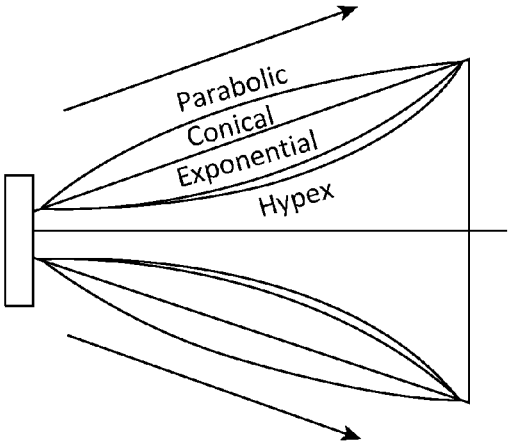
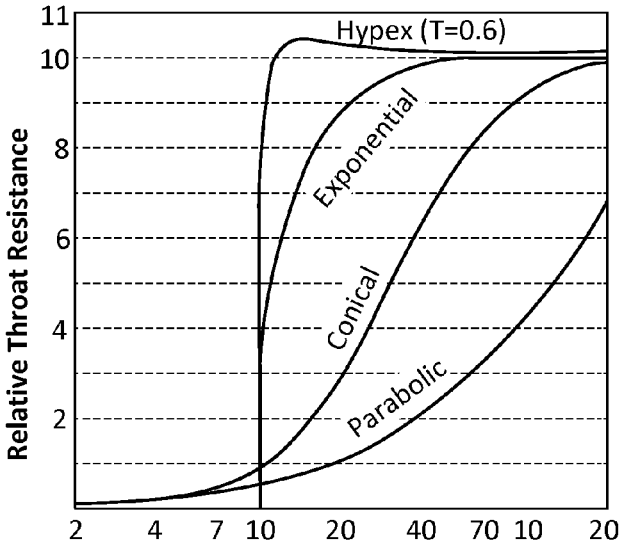
FIG. 4
FIG. 5
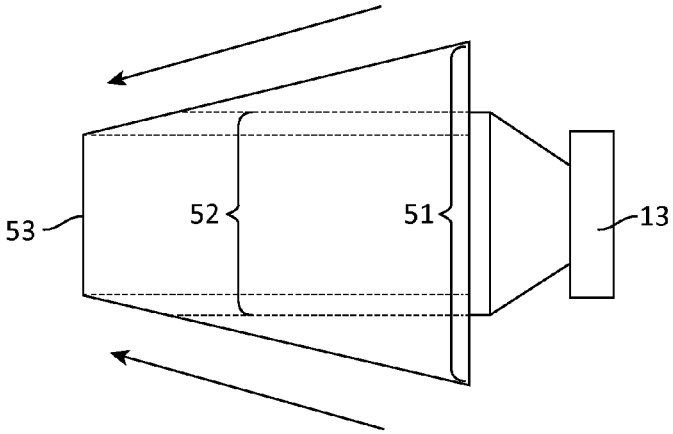

INVERSE HORN LOUDSPEAKERS

CROSS REFERENCE TO RELATED APPLICATIONS

This application is a continuation of application Ser. No. 13/316,793, filed Dec. 12, 2011, which is a continuation of application Ser. No. 12/877,950, filed Sep. 8, 2010. This application also claims benefit under 35 U.S.C. §119(e) to provisional application Ser. No. 61/240,589, filed on Sep. 8, 2009. The contents of these documents are incorporated by reference herein in their entirety.

FIELD OF THE INVENTION

The present invention relates to loudspeaker enclosure systems, and more particularly, to low frequency enclosure systems.

BACKGROUND OF THE INVENTION AND RELATED ART

In the art of loudspeaker systems it is desirable to obtain the extended low frequency response. In addition, it is generally desirable to minimize the size of the loudspeaker enclosure, for example to reduce cost and allow for more flexible placement. These two goals are often in opposition, and it is well known that obtaining extended low frequency response typically requires large, floor standing speakers with significant internal volumes, and/or large diameter woofers. Both options require tradeoffs in terms of efficiency, cost and flexibility of use, with large speakers typically being less efficient, costing more, and being less flexible in terms of placement in a listener's home.

There are a number of industry standard loudspeaker design approaches that have been used for many decades to achieve extended low frequency response. They generally fall into the categories of acoustic suspension, bass reflex, horn, and labyrinth or transmission line. The basic sealed enclosure or 'acoustic suspension' system, while the simplest of the devices, has significant limitations, typically including low efficiency and requiring very large driver diaphragm area and excursion capability to achieve reasonable outputs at low frequencies.

Bass reflex, or vented systems can increase efficiency by 3 dB or extend the −3 dB low frequency cutoff by approximately a half octave, or reduce enclosure size and achieve the same output at the same low frequency as a similarly sized sealed enclosure. These improvements are offset by problems with enclosure standing wave and pipe resonances exiting the vent, and for standard, maximally flat alignments, the systems are substantially ineffective at extending response below the free-air resonance of the transducer. in addition, vented design have problems with extreme diaphragm excursions below the cut-off frequency, reducing maximum output or requiring high pass filters to protect the woofer.

Transmission lines pass the acoustic output throughout an elongated labyrinth having a line length typically being ¼wavelength of the lowest usable frequency range; achieving extended low frequency response thus requires substantially increasing the size of the enclosure. In addition, the transmission lines utilize substantial damping material throughout the line length, which further reduces efficiency.

Existing expansion horns are known for high efficiency, but to achieve their potential they must have high expansion rates and horn lengths that correspond to approximately ¼ to ½ wavelength of the cut-off frequency. Again, this requirement results in very large sizes for a given low frequency capability.

Variations of the horn and pipe structure have been used to create tuned pipes, which also depend on a ¼wave pipe length at a lowest tuning frequency and cut-off frequency. These systems also suffer in having uneven frequency response and poor group delay, due to uncontrolled resonances in the transmission line.

SUMMARY OF THE INVENTION

Embodiments of the present invention provide loudspeakers with extended, even, low frequency response having high efficiency, using moderate and smaller enclosures and transducers.

In one embodiment, a loudspeaker enclosure has several compression chambers, including a primary compression chamber, and one or more secondary compression chambers. A transducer, such as a woofer, is mounted in a wall of the enclosure, radiating the acoustic output from its front side into the external environment and from its back side into the primary compression chamber. The primary compression chamber and the plurality of secondary compression chambers form an inverse horn, exiting from the primary compression chamber and by way of a series of compression steps couple the acoustic output to an exit to the external environment. The compression chambers each act to either increase or maintain the acoustic pressure from the prior compression chamber, thereby loading the driver for reduced and controlled diaphragm motions while efficiently coupling the transducer output to the environment. Further, a resonance-distortion filter chamber within the enclosure is acoustically coupled into one of the compression chambers. The filter chamber reduces parasitic pipe resonances and/or distortion components that arise from the output of the series of compression chambers. The filter chamber also couples its internal volume to the total internal volume of the system at low frequencies, thereby increasing the effective total enclosure volume, and thus lowering system resonance which allows for lower bass frequency extension, and thereby improving efficiency and low frequency extension.

The features and advantages described in this summary and the following detailed description are not all-inclusive. Many additional features and advantages will be apparent to one of ordinary skill in the art in view of the drawings, specification, and claims hereof.

BRIEF DESCRIPTION OF THE DRAWINGS

FIG. 3 illustrates various flare rates of for various types of expansion horns.

FIG. 4 illustrates relative performance of various types of expansion horns.

FIG. 5 illustrates the general form of an inverse horn.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
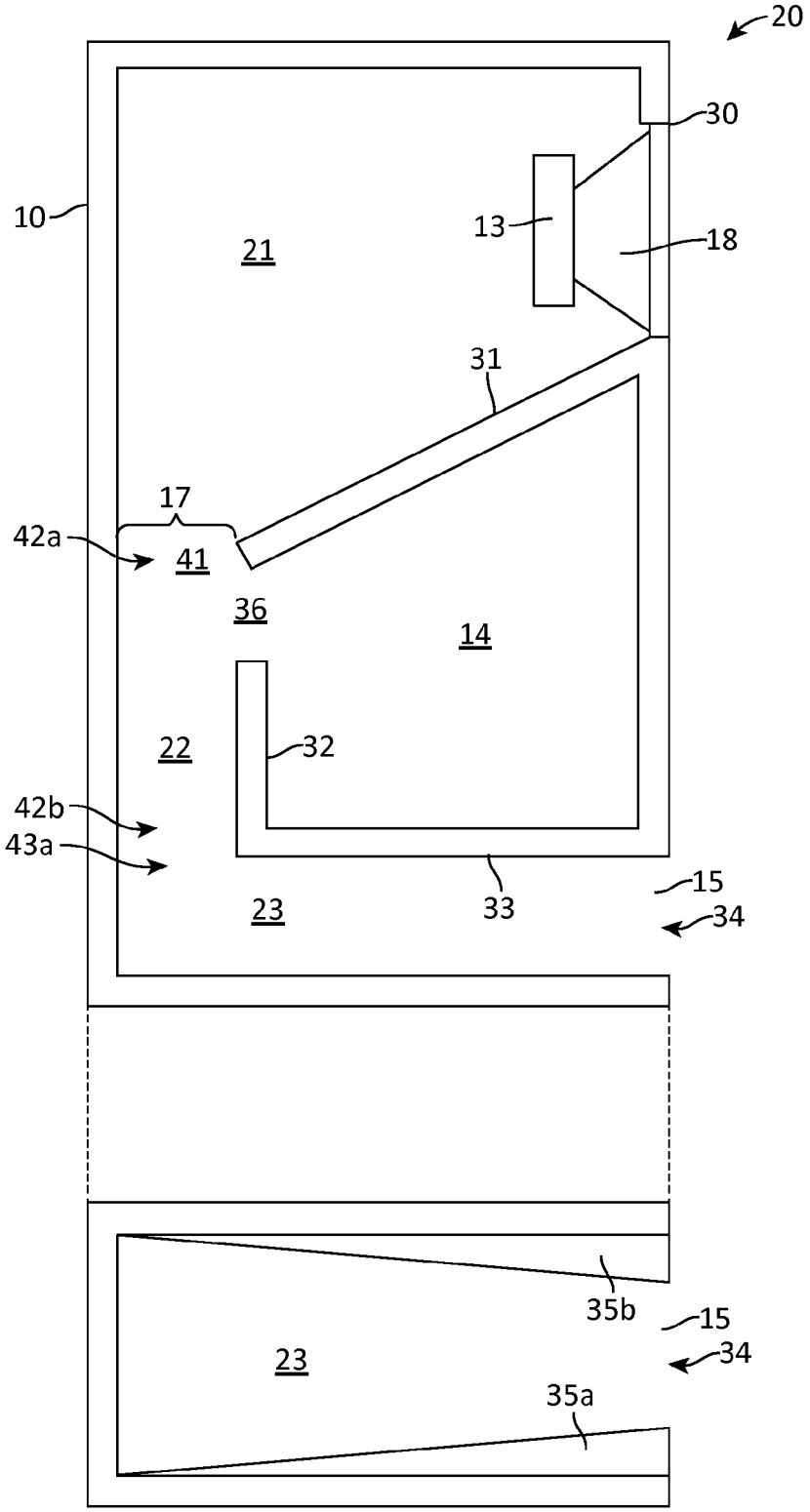
FIG. 1 illustrates an inverse horn loudspeaker having three compression chambers, one with constant compression.

FIG. 1 shows an embodiment of the invention with inverse horn enclosure system 10 comprising at least one electro-acoustic transducer 13 with a movable diaphragm 18 for converting an electrical input signal into a corresponding acoustic output at a pressure. The transducer 13 is mounted in a transducer opening 30 and radiates acoustic output from its front side to an external environment 20, and radiates from acoustic output from its backside into a first (primary) compression chamber 21 within the enclosure 10.

Compression chamber 21 is at least partially bounded by horn plate 31, which is configured to compress the acoustic output, and thus increase the pressure of the acoustic output, from diaphragm 18 towards an exit 41 of the chamber 21. The compressed acoustic output continues through entrance 42*a* of a secondary compression chamber 22 at least partially bounded by horn plate 32, through to the exit 42*b* of compression chamber 22. In this embodiment, compression chamber 22 maintains substantially constant cross sectional area from entrance 42*a* to exit 42*b* and is therefore referred to as a "constant" compression chamber, as it maintains level of pressure of the acoustic output from the primary compression chamber 21.

Exit 42*b* of compression chamber 22 connects to entrance 43*a* of a third compression chamber 23 (i.e., another secondary compression chamber) which is at least partially bounded by horn plates 35*a* and 35*b*. Horn plates 35*a* and 35*b* provide a continuous reduction in cross sectional area of the compression chamber 23, as the acoustic output traverses from entrance 43*a* to exit 15 of compression chamber 23. This provides continuous compression of the acoustic output, and increase in the pressure, and is therefore compression chamber 23 is referred to as a "continuous" compression chamber.

Compression chamber 23 couples to the exit 15 of the inverse horn system 10, which releases and radiates the compressed acoustic output from the series of compression chambers 21, 22, and 23 into the external environment 20. The inverse horn exit 15 may be flared in a manner well known (but not shown in FIG. 1) at the exit so as to minimize air turbulence and extraneous noise from the highly compressed pressures releasing into the external environment 20 from exit 15.

A resonance distortion filter chamber 14 (referred to hereinafter as a "filter chamber"), couples to secondary compression chamber 22. The acoustic compliance of the volume of the filter chamber 14 interacts with the acoustic mass of filter chamber opening 36 to form a Helmholtz resonator with a primary tuning frequency $F_r$. The filter chamber 14 reduces parasitic pipe or chamber resonances and/or distortion components that can be develop within the compression chambers 21, 22, and 23 and would be radiated into the external environment 20. Depending on the system, and the nature of the chamber resonance or distortion to be suppressed, the filter chamber 14 may be connected through filter chamber entrance 36 at any position along any of the horn plates 31, 32, 33.

At low frequencies below the Helmholtz resonant frequency $F_r$ of filter chamber 14 advantageously couples its volume to sum with the total internal volume of the system enclosure to increase the effective total enclosure volume to lower system resonance and allow for lower bass frequency extension, again improving efficiency and low frequency extension. More specifically, the volume of compression chamber 21 and the volume of filter chamber 14 combine and interact with the volumes and masses of the series of compression chambers 22 and 23 to realize a fundamental system tuning frequency $F_b$ that is below the Helmholtz resonant frequency $F_r$.

The above structural features allow for woofers, as may be used for transducer 13, to be selected with a free-air resonance $F_S$ that is higher than what is typically used to achieve extended low frequency response for a given size enclosure, relative to the lowest system tuning frequency $F_b$, or the system's low frequency cut-off frequency $F_c$. This in turn means that smaller and hence less expensive woofers can be employed. For example, woofer sizes can typically range from 2" to 12" used in various size enclosures, most common of which are 4.5", 5.25", 6", 6.5", 7", 8" and 10". Enclosure sizes have typically ranged from less than 0.5 cu. ft. to 2.3 cu. ft. While $F_S$ can vary depending on enclosure size, internal horn length and/or shape, and woofer size, it is typically higher than for standard sealed or vented designs and can commonly range from 50 Hz to 85 Hz for enclosures approximately 0.5 cubic feet and greater in internal volume. This is advantageous in that the stiffer suspension components used in higher $F_S$ woofer drivers can handle more power and exhibit lower distortion below the cutoff frequency $F_c$ where conventional systems can have severe distortion due to diaphragm excursions moving well beyond the reliable and linear limits of the woofer.

The Thiele/Small parameters in the transducer 13 for use in embodiments of the invention may include a higher $F_S$, as discussed above, a $Q_{ts}$, (Total Q), ranging from approximately 0.25 to 0.55, but are not necessarily limited to this range, depending on driver size and cabinet enclosure size. Transducer 13 sensitivity can range from 85 dB to 92 dB at 1 meter with 2.83 volts input, but can be greater or less.

Having described several aspects of one embodiment of the invention, it is helpful to now describe more generally the design principles of the invention. Generally, the various embodiments feature a hybrid design that physically and functionally combines the attributes of horns, bass reflex, and acoustic-air suspension designs into an integrated system. While each of these types of loudspeaker designs is well known and documented, they are typically used individually: the present invention integrates certain aspects of these designs and their respective associated acoustic principles so as to effectively cascade them together into hybrid design that takes uses attributes of each design to compensate for certain limitations of the others. These attributes are can then be further combined with a resonance distortion filter chamber.

More specifically, one loudspeaker design element used in embodiments of the invention is an Inverse horn, as illustrated in FIG. 5. To provide a context for the inverse horn, FIG. 3 depicts various typical horn designs and flare rates, where the transducer is located on the left, and the output of the transducer flows toward the flare of the horn. FIG. 4 shows a reference graph of how each type of horn loads output at specific frequencies. it is clear that the Hypex type horn design will load the lowest in frequency, due to having the tightest throat section where the flare rate is extremely nominal, maintaining a tight cross-sectional area, which in turn maintains strong pressure on the transducer diaphragm. As illustrated in FIG. 5, the inverse horn aspect takes this one step further and draws the tightness of the flare in a continuous manner through the length of the horn, an inverse conical shape in this case, which is functionally similar to the enclosures described herein. The inverse horn can take many forms, including inverse exponential, inverse conical, inverse Hypex, and so forth. The inverse horn aspect of the embodiments is provided by the compression chambers, where the output of the transducer 13 is essentially coupled as the widest end of a horn formed by the series of compression chambers, and the horn plates acting as the flared portions.

Typical horns have a throat area equal to or smaller than the driver diaphragm and proceed to expand at some rate of flare. This creates an acoustical transformer that provides a match of the air load from the driver diaphragm to the air mass in the environment, this main advantage of which is increased sensitivity of the speaker. The inverse horn design used in the embodiment has a throat area 51 that is equal to or larger in cross-sectional than the piston radiating area 52 of the transducer 13. The cross-sectional area of the inverse horn then decreases in size through part or all of the horn length such that the end or mouth 53 of the horn is then typically equal to or smaller in cross-sectional area to that the piston radiating area 52 of the transducer.

Figure 2:
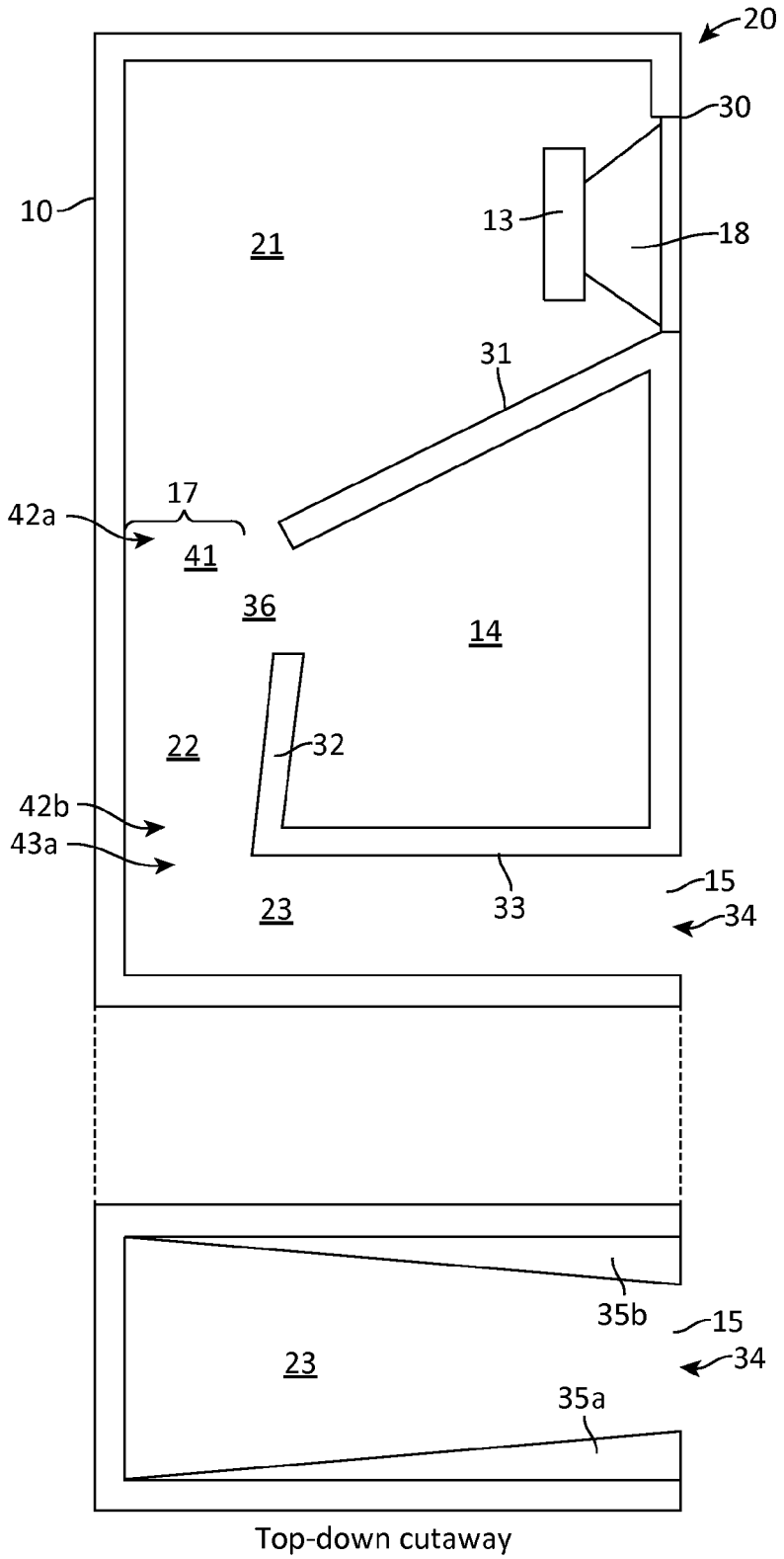
FIG. 2 illustrates an inverse horn loudspeaker having three compression chambers, one with continuous compression.

For example, in FIG. 1 and FIG. 2, the inverse horn comprises three stages. The first stage starts with a first horn plate 31, a diagonally placed partition that slopes away from the central axis of the transducer 13, providing a pressure area between the end of horn plate 31 and the inside back of the enclosure. Such a pressure area can typically be greater than, equal to, or slightly smaller in cross-sectional area than the piston radiating area of the transducer 13 depending on enclosure size, frequency extension desired, woofer parameters and other factors.

Referring again to FIG. 1, compression chamber 22 is formed between horn-plate 32 and the walls of the enclosure, and provides a second stage to the inverse horn in length, while further increasing its length. The acoustic output flows through the second-stage at a constant rate of compression, with the cross-sectional area and pressure at pressure area at the beginning of horn-plate 32 being the same at the end of horn-plate 32. The third stage of the inverse horn extends along horn plate 33 to the exit 15. In compression chamber 23, two triangularly shaped cleats 35*a* and 35*b* continue to decrease in cross-sectional area from the inside back of the enclosure 10 to the inverse horn exit 15, increasing air flow pressure through such and forming pressure area 34 at the inverse horn exit 15. The full inverse horn in this embodiment then has increasing (continuous) compression at first in compression chamber 21, then maintains that compression at a constant rate through compression chamber 22 down to horn plate 33 where compression chamber 23 then again begins increasing compression to the horn cutoff point at the inverse horn exit 15. The enclosure includes a three-stage inverse horn.

FIG. 2 depicts another front inverse horn enclosure 10 also with three stages. Here, horn plate 32 starts below the filter chamber entrance 36 into filter chamber 14, directly below the end of horn plate 31 and extending downwardly, forming compression chamber 22 as a second stage to the inverse horn. Compression chamber 22 has a reduction in cross sectional area from entrance 42*a* to the exit 42*b*, which compresses the air flow at a continuous rate of compression. Horn plate 32 acts as a continuing compression coupler to compression chamber 23. Compression chamber 23 is the third stage of the inverse horn system, extending and continuing compression all the way to the horn cutoff at the inverse horn exit 15.

In the embodiments of FIGS. 1 and 2, the extended length of the inverse horn provided by the multiple compression chambers extends the low frequency cutoff of the system, and does so with balanced amplitude at the lower achieved frequency while maintaining low distortion. As can be appreciated by those of skill in the art, this improved performance can be achieved with relatively small internal air volumes as typically found in bookshelf or stand mounted speakers, and with similar or smaller drivers with equal or higher free-air resonances. The number of compression chamber horn stages, compression chamber sizes, pressure area cross-sectional sizes, can be varied, as can the compression rates and types of each stage, provided a generally decreasing cross-sectional area is maintained through the inverse horn with the smallest of such cross-sectional area at the exit 15 of the horn, which is generally equal to or smaller in cross-sectional area than the piston radiating area of the transducer 13.

One of many possible alternative internal layouts that can provide an inverse horn in accordance with the principles of the invention comprises one internal partition forming a curved surface extending from about where horn plate 31 meets the inside of the enclosure 10 under the transducer 13 all the way to the inverse horn exit 15. The curve can be in the form of an inverse exponential, Hypex, or other curved horn shape. An advantage of the design includes adding length to the inverse horn to again lower the cutoff frequency augmented by the shape of the horn's curve. An aspect in these designs is that the inverse horn outputs at the exit 15 a range of frequencies, which are primarily below, and not above, the woofer's free-air resonance. In contrast, typical vented enclosure systems are tuned above their woofer driver's $F_S$, not below.

The primary limitation of typical horn loudspeakers is that they must be very large to reproduce the lowest frequencies. This is due to the decreasing electrical to acoustic conversion efficiency as frequencies reproduced get lower and lower in the extended bass range. By comparison, the inverse horn design shown here provides both high sensitivity and extended low frequency response in a relatively small enclosure size. The higher sensitivity is due to the increasing sound pressure level in the extended low bass frequency, thus reducing the need for additional power. The result of this higher sensitivity is that, for a given amplifier power, the maximum output level is increased and consequently, the dynamic range capability is increased. Further, the back-pressure control of the transducer excursion and increased electrical to acoustical conversion efficiency also allows the inverse horn to be shorter in length as compared conventional horn to achieve the same level of frequency extension. The result is that much smaller cabinet enclosures can be used to achieve lower extended bass along with improved dynamic range.

Figures 6A, 6B:
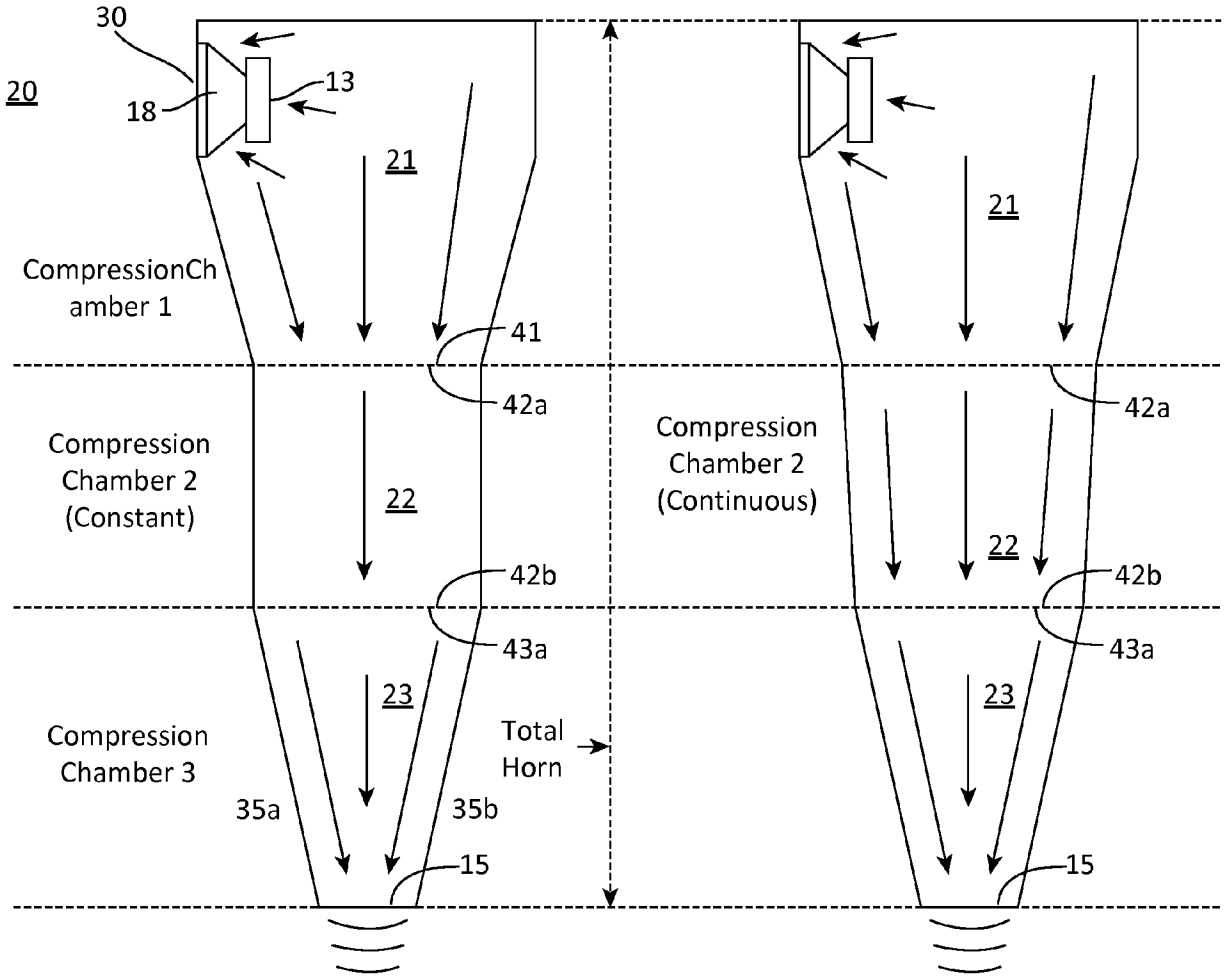
FIGS. 6*a* and 6*b* are unfolded illustrations of inverse horns according to embodiments of the invention.

FIGS. 6*a* and 6*b* further illustrate the relationships of the plurality of compression chambers. FIG. 6*a* shows an unfolded, linear expression of a three compression chamber inverse horn structure. Shown is electro-acoustic transducer 13 with a movable diaphragm 18 for converting an electrical input signal into a corresponding acoustic output at a pressure. The transducer 13 is mounted in a transducer opening 30 and radiates acoustic energy to an external environment 20 and into a first internal volume compression chamber 21. Compression chamber 21 is configured to increase pressure from the rear of diaphragm 18 towards a first exit 41. Compressed acoustic energy continues through entrance 42*a* of a second, compression chamber 22, through to the exit 42*b* of compression chamber 22. In this illustration, compression chamber 22 maintains substantially constant cross sectional area from entrance 42*a* to exit 42*b* and is considered a constant compression chamber. A constant compression chamber is bounded at either its entrance 42*a* or its exit 42*b* by a continuous compression chamber, such as compression chambers 21 and 23. Exit 42*b* of compression chamber 22 connects to entrance 43*a* of compression chamber 23 which is at least partially bounded by horn plates 35*a* and 35*b* providing continuous reduction in cross sectional area as the acoustic energy traverses from entrance 43*a* to exit 15, of compression chamber 23, which releases and radiates the compressed acoustic energy from the series of compression chambers 21, 22, and 23 into the external environment 20. Further, each compression chamber differs from the others in terms of at least volume, taper, cross-sectional areas of its openings, which can cause a predetermined differentiated compression along the stages of the inverse horn.

FIG. 6*b* shows essentially the same device as FIG. 6*a* but with compression chamber 22 having a decreasing cross sectional area from its entrance 42*a* to its exit 42*b*, creating an increasing or continuous compression as acoustic energy traverses the compression chamber 22, thereby referred to as a continuous compression chamber. This chamber is bounded by continuous compression chambers 21 and 23. This embodiment provides continuous compression along the entire length of the inverse horn.

Figures 7A, 7B:
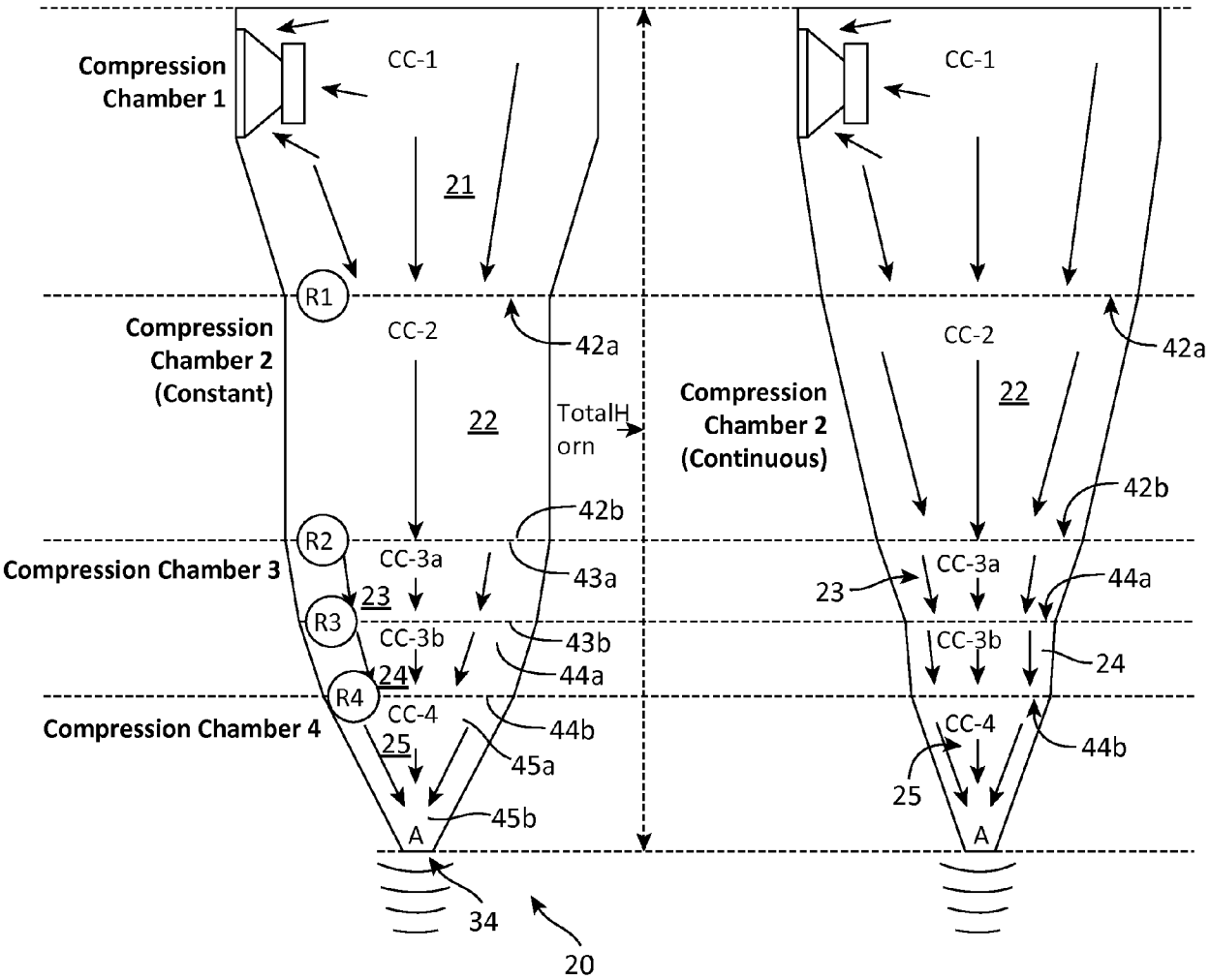
FIGS. 7*a* and 7*b* are unfolded illustrations of the inverse horns with additional compression chambers, according to embodiments of the invention.

FIG. 7*a* shows a similar device to FIG. 6*a* but with two additional compression chambers 24 and 25. As in FIG. 6*a*, constant compression chamber 22 has a constant cross sectional area from its entrance 42*a* to its exit 42*b*, creating a constant compression as acoustic energy traverses the compression chamber 22. This chamber is bounded by continuous compression chambers 21 and 23. Compression chamber 22 output exit 42*b* is coupled to entrance 43*a* of continuous compression chamber 23. The output exit 43*b*, of compression chamber 23 is coupled to entrance of 44*a* of continuous compression chamber 24 which has its output exit 44*b* coupled to the entrance 45*a* of increasingly continuous compression chamber 25. Compression chamber 25 has exit 45*b* which couples the acoustic energy to the external environment 20. The rates of compression and changing rates of compression are determined by the system designer to provide effective loading of the diaphragm for minimum excursion, most linear system frequency response summation of the all the compression chambers and the driver output mixing in the external environment, maximum low frequency extension and lowest system distortion.

FIG. 7*b* shows a similar device to FIG. 7*a* but with compression chamber 22 being a continuous compression chamber, with decreasing cross sectional area from entrance 42*a* to exit 42*b*. Also, a difference with the device of FIG. 7*b* is that it has a constant compression chamber 24 with constant cross sectional area from its entrance 44*a* to its exit 44*b*. Compression chamber 24 is bounded by increasing or continuous compression chambers 23 and 25.

FIG. 1 and FIG. 2 also illustrate additional benefits of the increased horn lengths relative to an enclosure with two compression chambers. First, the additional length allows for lower bass extension at high amplitude. Second, compression chamber 21 has been reduced in relative size while the distortion filter chamber 14 has increased. Third, the compression rate through compression chamber 21 is typically greater, augmenting the longer horn to further lower extended bass response. Fourth, the filter chamber 14 has increased size, which allows for lower harmonics, which are generally the most undesirable ones, of the extended low bass frequencies to be reduced in amplitude for a cleaner sound. Many internal layout designs can be made and varied to achieve specific performance and packaging goals consistent with the principles of the present invention.

The second design principle which is integrated into the hybrid design is the bass reflex. Bass reflex designs are typically created by including at least one vent or port, other than the woofer opening, to the outside of the enclosure. The port's cross-sectional area can be varied to raise or lower the tuning frequency desired. Bass reflex designs have a resonant frequency at which the mass of air in the port reacts with the volume of air in the cabinet to create output, which is also sometimes called its tuned frequency. Typically, the diaphragm excursion is typically the least at this tuned frequency. With such minimal diaphragm excursion or movement, distortion goes down, while the output at the port is at its highest in amplitude.

The embodiments of the invention maintain positive aspects of bass reflex design, but have a number of attributes which improve upon the typical bass reflex system. One improved attribute is the ability to use higher $F_S$ transducers 13, with reduced compliance suspension systems, allowing more robust resistance to over-excursion of the diaphragm at sub $F_b$ frequencies along with faster reaction time of the diaphragm coming back to rest. Another problem that plagues bass reflex designs is the presence of standing waves and pipe resonances relative to the vent length and/or the tuning frequency that arise within the enclosure, resulting in uneven low- and mid-bass frequency response. To minimize these problems, filter chamber 14 is tuned by adjustment of its volume, opening size, opening location, and damping so that it can filter out these resonances, reducing sonic colorations and creating a much more accurate acoustic output. In addition, in various embodiments, the placement of the internal horn plates creates unparallel surfaces inside the enclosure 10, which further helps eliminating standing waves.

The third design principle integrated into the hybrid design is that of a sealed, acoustic air-suspension enclosure design. In this type of design the air mass in the sealed enclosure, provides a reactance, air load, against the driver's diaphragm, limiting its excursion and thereby helping to control such from over-excursion. Limiting over-excursion reduces, and to a degree pressurizes its front radiation output.

The embodiments of the invention also use this air-mass control of excursion of the driver's diaphragm. The placement of horn plate 31 in FIG. 1 and FIG. 2 which at its end, creates a pressure area at exit 41 at the toward the back of the enclosure 10. The cross-sectional area at this pressure area at exit 41 is reduced compared to the average cross sectional area of compression chamber 21 and in a typical system is comparable to the area of the diaphragm 18, desirably between 0.75 and 2.5 times the diaphragm area 18 for typical enclosure sizes, and more preferably, between 1.0 and 2.0 times the diaphragm area 18; as a result air-flow at this point begins to back up into compression chamber 21 and in so doing places an air-load pressure against the back of the transducer diaphragm 18. Such air load can be controlled based on the size and shape of compression chamber 21 and by increasing or decreasing the cross-sectional area of the exit 41. As the area of exit 41 can also be larger than the piston radiating area of the woofer, and if so, the cross-sectional areas at entrance/exits 42*a*, 42*b*, 43*a* end up being equal to or smaller than the piston radiating area of the transducer, as the cross-sectional area of the inverse horn gets smaller and smaller throughout its length. Any pressure area created in the horn that is basically equal to or smaller than the previous pressure area, or piston radiating area of the transducer will force the air to back up into the enclosure and place an air load on the back of the transducer diaphragm 18, reducing its motion and potential distortion at high output levels without reducing the system acoustic output either directly from the transducer diaphragm 18 to the external environment 20 or through the exit 15 to the external environment 20. More specifically, such back pressure serves to increase output at the exit as well as to mildly pressurize radiation from the front of the diaphragm 18.

The filter chamber 14 as seen in FIG. 1 and FIG. 2 provides additional beneficial features when used in conjunction with the above described elements. A common method of reducing unwanted resonances in loudspeaker enclosures is to stuff or line major portions of the interior of the enclosure with some type of damping material, acoustic wool, fiberglass, polycell foam, or similar. This does not necessarily target the specific frequency or set of frequencies desired, and thus results in over-damping of some frequencies and under-damping of others, with an attendant uneven frequency response. Secondly, such damping material reduces acoustic amplitude due to the loss of acoustic energy in the form of heat. Any such loss is a loss in output and dynamic range. In contrast, the filter chamber 14 provides much more targetable and controlled reduction of internal resonances.

Figure 8:
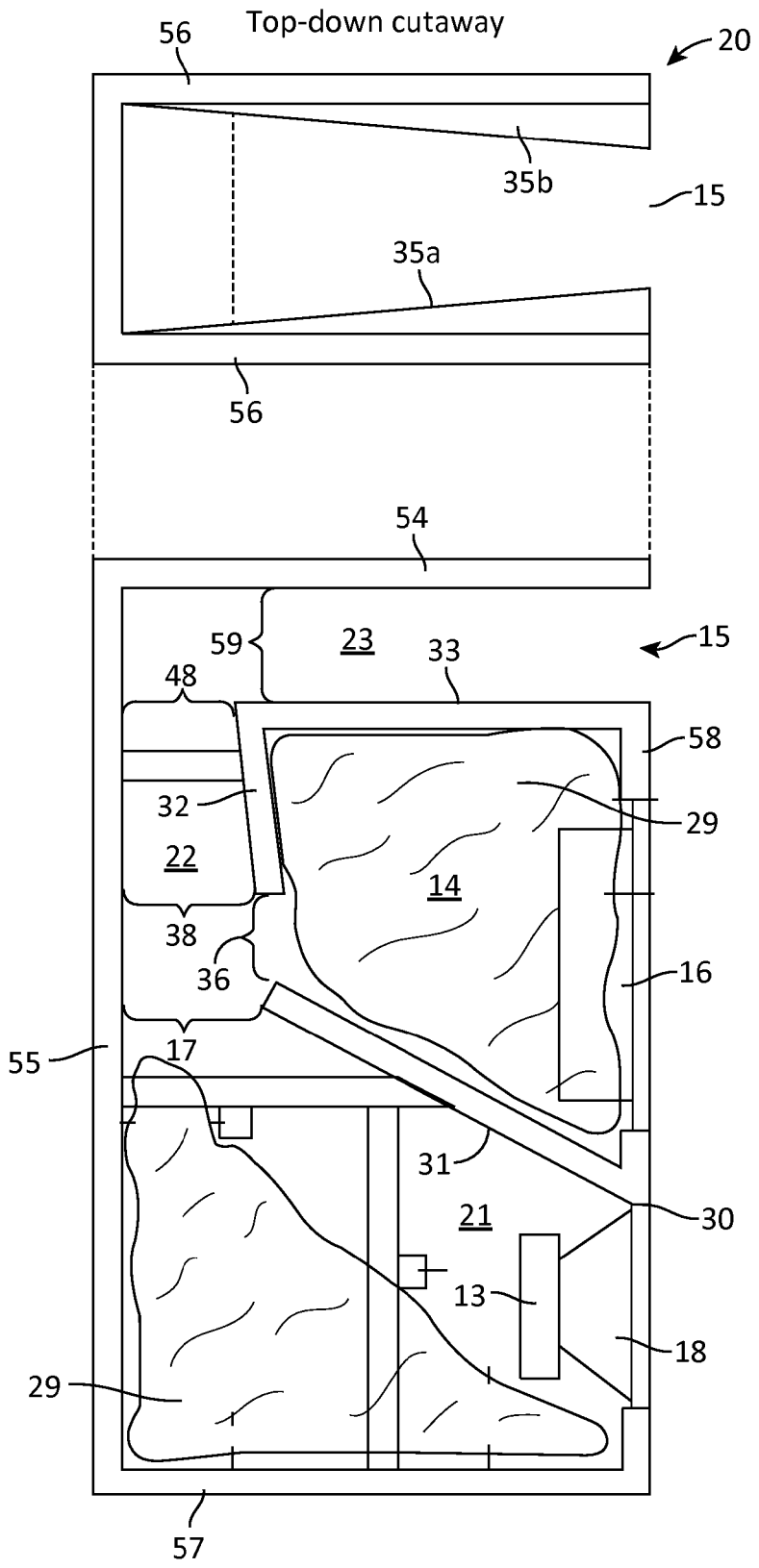
FIG. 8 illustrates another loudspeaker having three compression chambers and a forward facing exit.

For acoustic waves to gain efficient entrance to the filter chamber 14 area it can be desirable to have a pressure area provided near the filter chamber entrance 36. The filter chamber entrance 36 is typically placed anywhere along horn plate 32, but can be placed in horn plate 31 or horn plate 33 or in communication with any compression chamber. Referring to FIG. 8, by placing damping material 29 in the volume of the filter chamber 14, a specific area which is designed to allow a specific set of frequencies to reside, the acoustic energy of these frequencies is reduced in amplitude before it reemerges back through its 36, where a pressure area is formed. The wavelength of the enclosure's system resonance frequency is normally much larger than that to which the filter chamber 14 is designed. However, the filter chamber 14, can be sized to effectively accommodate the harmonics of the enclosure's resonant frequency, such as the 2nd, harmonic, third harmonic, and so forth. With damping material, fibrous wool, Owens-Corning type fiberglass, polycell foam or the equivalent, placed in the filter chamber 14 these harmonic frequencies are reduced in amplitude before they reemerge from the filter chamber 14. This can help smooth response and reduce distortion, which usually translates to lower sonic coloration and cleaner overall sound. Because the damping is limited to the filter chamber 14, the overall amplitude of the acoustic output is not substantially impacted, as only the acoustic energy at the distortion frequencies is reduced.

Also beneficial is the filter chamber's effect on those frequencies emanating from the inverse horn exit 15. Generally, embodiments of the invention output from the exit 15 usable frequencies from approximately 80 Hz down. These frequencies vary depending on enclosure size, woofer size and characteristics, the inverse horn's length and taper rate in the enclosure, and other factors. The filter chamber 14 acts as a distortion filter for unwanted harmonics of the low bass frequencies emanating from the exit 15, reducing the acoustic energy of these harmonics, and providing a more even bass response. If, for example, the peak amplitude response at the exit 15 is at 32 Hz, the second, third, and fourth harmonics of 32 Hz as a fundamental frequency are 64 Hz and 96 Hz and 128 Hz respectively. They are closest to the fundamental frequency of 32 Hz, and consequently, the highest in amplitude as well. Low frequencies, such as 32 Hz, typically involve considerable diaphragm movement to reproduce, even at low volumes. The inherent mechanical complications that a woofer faces when reproducing very low frequencies tends to introduce high distortion, especially as sound pressure levels are increased. Excess diaphragm movement translates to excess distortion. As the measurements below show, frequencies emanating from the exit 15, even while high in amplitude, demonstrate very low distortion, especially in light of the well extended low bass frequencies being reproduced and their high amplitude responses.

While the filter chamber 14 does act to help to reduce distortion of the harmonics associated with those frequencies emanating from the exit 15, it does not affect the correspondingly same frequencies as fundamentals. For example, if the filter chamber 14 is tuned to 126 Hz, it acts to reduce 126 Hz in amplitude as an undesired harmonic of those frequencies emanating from the exit and those generated within the enclosure as part of usually undesired system resonances. However, it does not at all affect 126 Hz as a fundamental frequency itself in the program material being reproduced. Such frequency as a fundamental emanates from the front of transducer 13 itself and directly into free space, not through the enclosure, remaining unaffected by the filter chamber 14.

FIG. 8 illustrates another embodiment in cross-sectional view of an enclosure 10 having a bass driver-transducer 13 and midrange-tweeter ribbon driver 16. As an example, this enclosure can have an internal volume of 1.5 cu. ft., with 7" ribbon driver, and 6.5" transducer 13 having with a piston radiating area of 22 square inches; the transducer's free-air resonance, $F_S$ is 63 Hz. This free-air resonance is higher than that typically used in conventional bookshelf and any many tower loudspeaker models. The Total Q, Qts, is 0.42.

The enclosure includes the top wall 54, side wall 56, bottom wall 57, and front baffle 58. Included is a first horn plate 31, a second horn plate 32, and a third horn plate 33. They form three compression chambers 21, 22, 23, which function as a reduced taper in the manner of an inverse horn, as described above. A first compression chamber 21 is coupled to the rear side of transducer 13. In this example embodiment, damping material 29 is shown to partially fill compression chamber 21 for the purpose of absorbing standing waves in the chamber 21 nearest the transducer. A portion of the compression chamber 21 is left clear of damping material and all other compression chambers are kept free of damping material so as to maximize inverse horn efficiency. As the air flow from the back of the transducer 13 progresses into compression chamber 21, the chamber's cross-sectional area becomes increasingly smaller, compression the air flow to the tightest point at the end of compression chamber 21 at a first pressure area 17. At such a location at the end of first horn plate 31 there is filter chamber entrance 36, with a cross-sectional area the same as that of pressure area 17 which is the entrance into the filter chamber 14. As compressed air flow from compression chamber 21 comes through pressure area 17 it can then enter the filter chamber 14 through the filter chamber entrance 36 as well as begin to enter a second pressure area 38, the entrance into a second compression chamber 22.

The filter chamber 14 helps minimize system resonance distortion. By filling the filter chamber 14 with damping material 29, in the case of FIG. 8, enclosure 10, the amplitude of unwanted harmonic frequencies of system resonance can be reduced by the effect of the filter chamber 14. Secondly, by reducing the effects of these unwanted resonances, and the associated pressure on the enclosure walls 54, 56, 57, 58, sound emanating from vibration of these walls is also reduced. The filter chamber 14 also performs a second function, that of acting as a distortion filter for the frequencies emanating from the inverse horn exit 15. The effect of the filter chamber 14 is further discussed below with respect to FIG. 9*c*.

Referring again to FIG. 8, air flow proceeds beyond the filter chamber 14 and into compression chamber 22, formed by horn plate 32 extending from the top of the entrance 36 to the filter chamber 14 to connect with the back end of the horn plate 33. Here, there is a pressure area 48, the cross-sectional area of which is preferably smaller than the cross sectional area of pressure area 38 at the beginning compression chamber 22. This is to both create a continuing reduction in the cross-sectional area of the inverse horn to further continue to compress the air flow as it flows through compression chamber 22 and to provide a better air flow transition from compression chamber 22 to compression chamber 23 which is the third stage of the inverse horn. The cross-sectional area of a fourth pressure area 59 is a function of both the height in compression chamber 23 from the top of horn plate 33 to the inside of top 54 and the width in compression chamber 23 at pressure area 48. Triangular cleats 35*a* and 35*b* reduce the cross-sectional area in compression chamber 23. The decreases in the cross-sectional area as the airflow travels to the inverse horn exit 15, provides continuous compression of the airflow. This creates a smooth transition of air-flow while at the same time substantially increasing the continuous compression of the air from compression chamber 22 into compression chamber 23. Compression chamber 23 then continues to reduce in cross sectional area to further continue to compress the air flow all the way to the inverse horn cutoff point, which is also the inverse horn exit 15 for the air to now leave the enclosure 10 and enter the external environment 20 or listening room. In this example, compression is accomplished by the use of tapered compression cleats 35*a* and 35*b*, but could also be accomplished otherwise (by angling horn plate 33, for example).

Figure 9A:
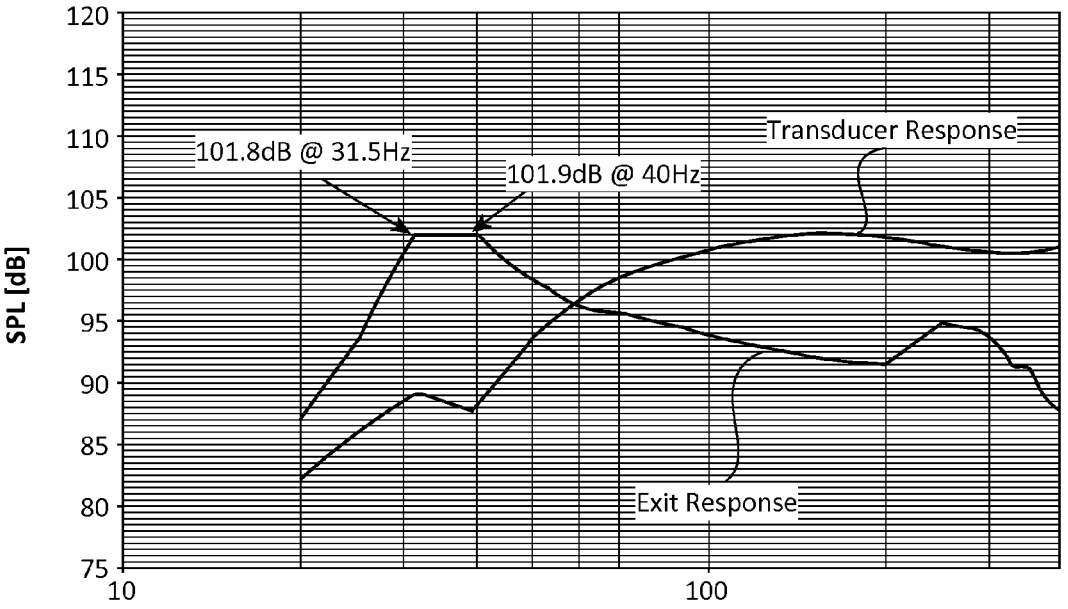
FIG. 9*a* is a graph of the transducer and exit frequency responses of a loudspeaker similar to the configuration shown in FIG. 8.

FIG. 9*a* is a graph depicting the transducer and exit frequency responses of a bookshelf monitor similar to that shown in FIG. 8, but employing horn plate 32 in a manner creating compression chamber 22 with constant compression (rather than the continuous compression shown in FIG. 8). This, together with horn plate 33 creating compression chamber 23 increases the overall length of the inverse horn, which has three compression stages. As clearly seen in FIG. 9*a*, the frequency response is extended down to 31.5 Hz with output of 101.8 dB. Likewise, output at 40 Hz remains even and high in amplitude with output of 101.9 dB. Thus, extended, uniform low frequency output is achieved. The input voltage of 0.5 v was chosen to reflect the high output achieved, 101.8 and 101.9 dB, at such extended low frequencies.

Figure 9B:
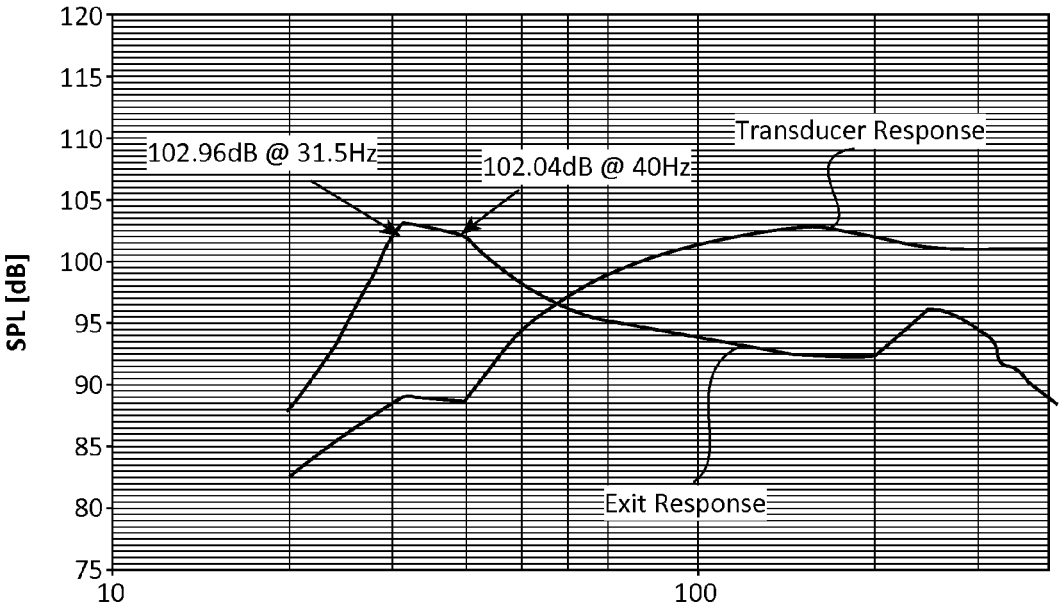
FIG. 9*b* is a graph of the transducer and exit frequency responses of a loudspeaker according to the configuration shown in FIG. 8.

FIG. 9*b* is a graph depicting the transducer and exit frequency responses of bookshelf monitor such as shown in FIG. 8. Clearly seen is that with the increased compression of compression chamber 23 the low bass response is extended to 31.5 Hz but now at an amplitude of almost 102.96 dB, an increase of over 1.1 dB relative to the constant compression horn. Output at 40 Hz has also increased as well to 102.04 dB. Of note, the −3 dB point of 29 Hz is slightly higher in amplitude, meaning the response has been slightly extended lower as well. The same nominal 0.5 v input was used.

Figure 9C:
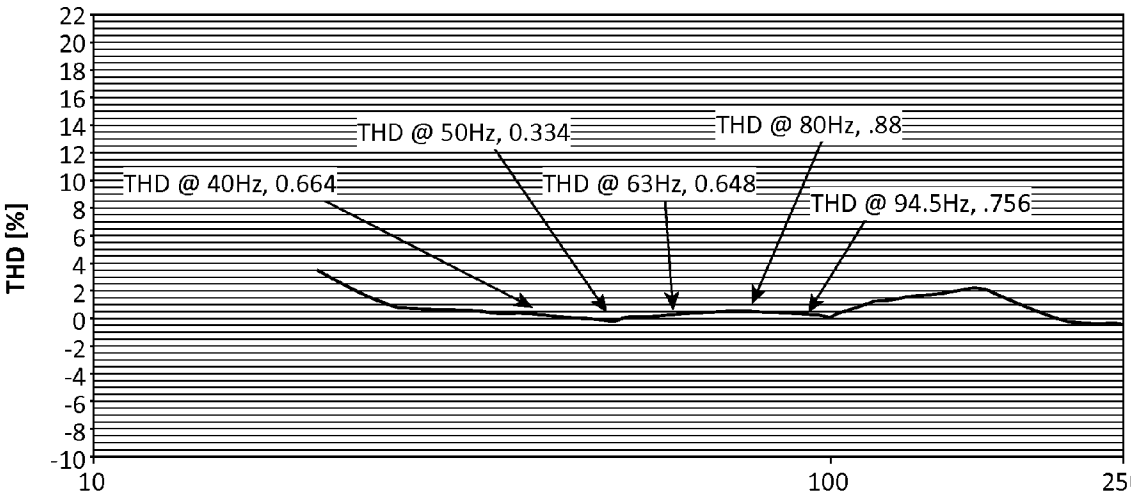
FIG. 9*c* is a graph of the THD of a loudspeaker according to the configuration shown in FIG. 8.

FIG. 9*c* is a graph of the THD of the above frequency response in FIG. 9*b* taken at the inverse horn exit 15, from 10 to 250 Hz. At 31.5 Hz with 0.5 v input the output at the exit 15*b* is 102.96 dB and at 40 Hz 102 dB. From 40 Hz up to 94.5 Hz the THD ranged from 0.3% to 0.8%. Of interest here are the frequencies from 63 Hz up, especially 63 Hz itself. This is the system resonance frequency of the enclosure illustrated in FIG. 8, and virtually that of the transducer $F_S$. It is at this frequency where the transducer will tend to react most strongly and distortion is normally high in conventional designs. But the first distortion product of 63 Hz is 126 Hz, which is the peak frequency of the filter chamber 14. In this case the filter chamber 14 is reducing the level of this harmonic, and so rendering 63 Hz among the lowest in THD along the whole THD curve. Likewise, 63 Hz and 94.5 Hz are the second and third harmonics respectively of 31.5 Hz, the highest amplitude frequency emanating from the exit. The THD at these frequencies is only 0.6% and 0.7%. These are quite good distortion measurements in any event, but are more impressive considering the low, extended frequencies and high output levels achieved.

Figure 9D:
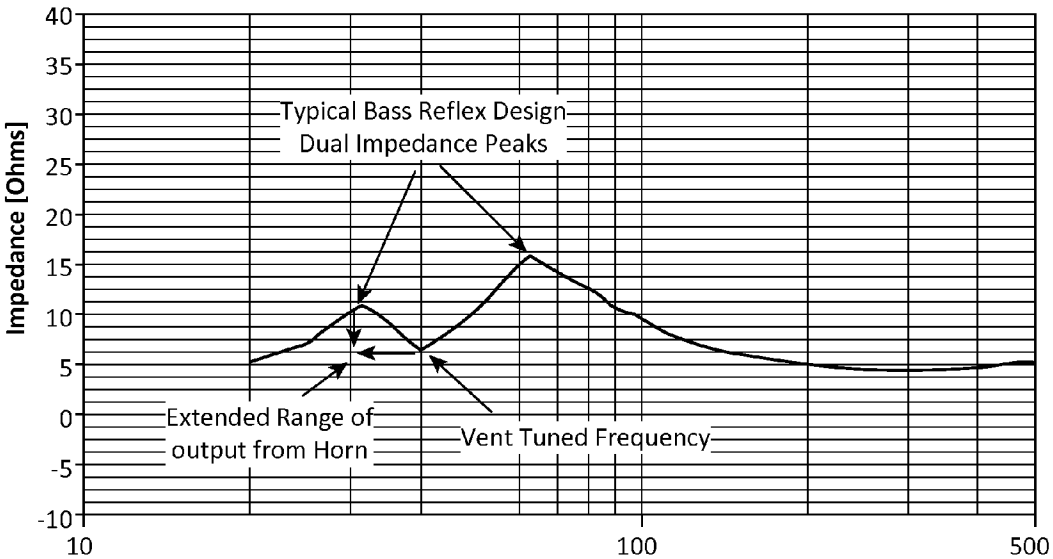
FIG. 9*d* is a graph of the impedance curve of a loudspeaker according to the configuration shown in FIG. 8.

FIG. 9*d* is an impedance curve graph of the enclosure illustrated in FIG. 8, with the exit 15 open, as in normal loudspeaker operation. Immediately evident are now two peaks in the impedance curve, typically indicative of a bass reflex loudspeaker design. The first peak (left side), is due to the interaction of the air load in the cabinet with that in the exit. The second peak, (right side), is that due to the transducer's $F_S$, and the air in the cabinet in the enclosure; in conventional designs, this is usually at a mid-bass frequency. The lowest point between these two peaks is usually the frequency at which the exit is tuned, output is the highest, transducer movement is least and distortion is relatively low. However, in the case of FIG. 8, this tuned frequency is 40 Hz as seen in the overall impedance curve.

Referring to FIG. 9*a* and FIG. 9*b* again, both showing the extended response from the exit 15 it can be seen that usable output actually extends well below 40 Hz, the tuned port frequency as seen in the impedance curve, down almost a full half octave to 31.5 Hz before beginning a sharp roll-off in amplitude. This extension of range is indicative of the inverse horn design principles also at work in the enclosures shown in FIGS. 1 and 2, where the longer inverse horn has improved the amplitude response beyond the typical performance of a conventional tuned port. Both the additional extended range and the sharp cutoff immediately afterwards are indicative of the hybrid nature of the inverse horn design and its associated acoustic principles.

Figure 9E:
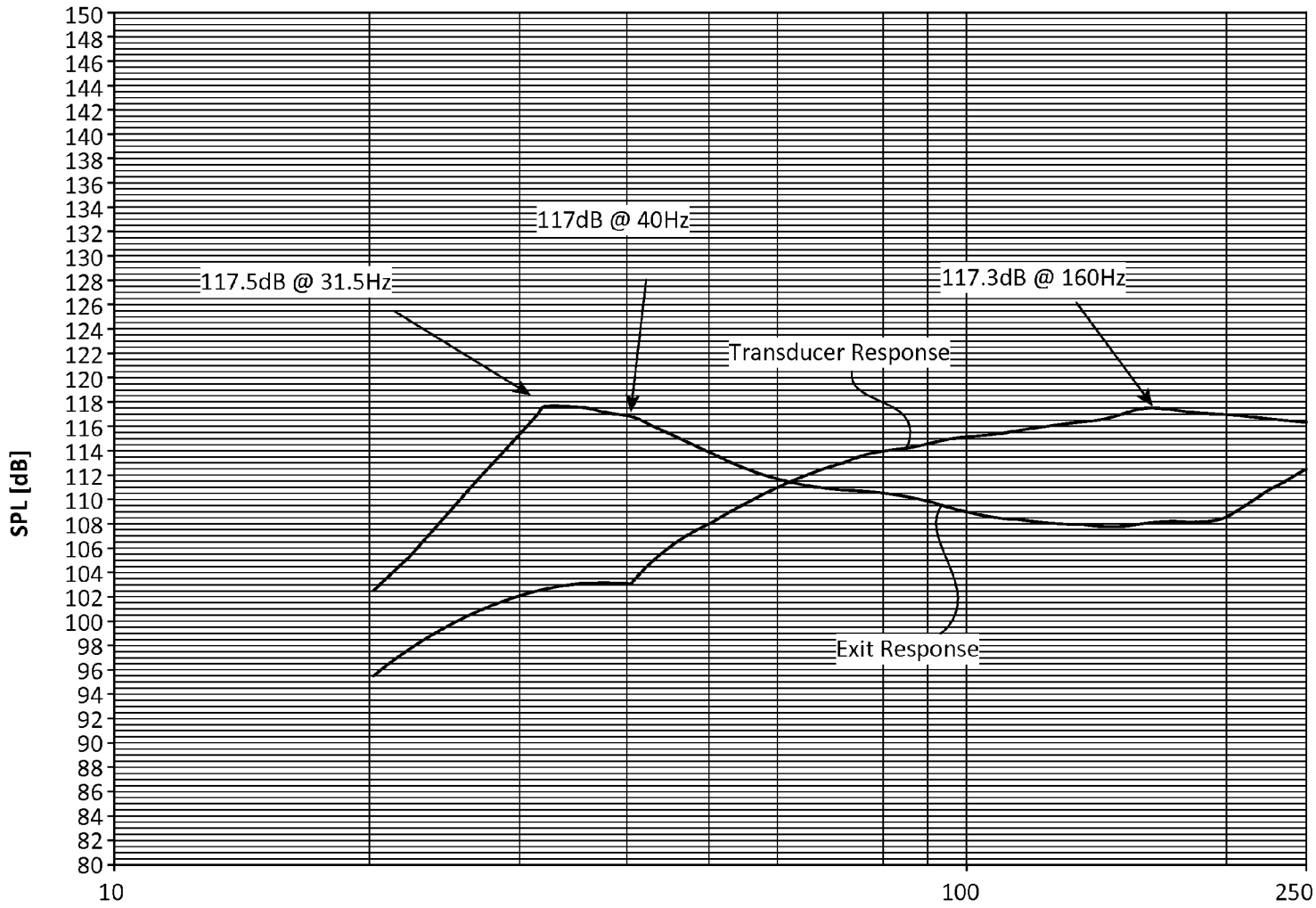
FIG. 9*e* is a graph depicting the transducer and exit frequency responses of an inverse horn enclosure.

FIG. 9*e* is a graph depicting the transducer and inverse horn exit frequency responses for an enclosure as such as shown in FIG. 1. The input level has changed, however, to 2.83 v, the equivalent of 1 watt. Clearly seen is that the peak low bass response is still extended to 31.5 Hz, but now at an amplitude of 117.5 dB. Output at 40 Hz has also increased as well to 117 dB. These are exceptionally high amplitudes for such extended low frequencies, especially being achieved with only 2.83 v input, the usual equivalent of 1 watt.

Figure 9F:
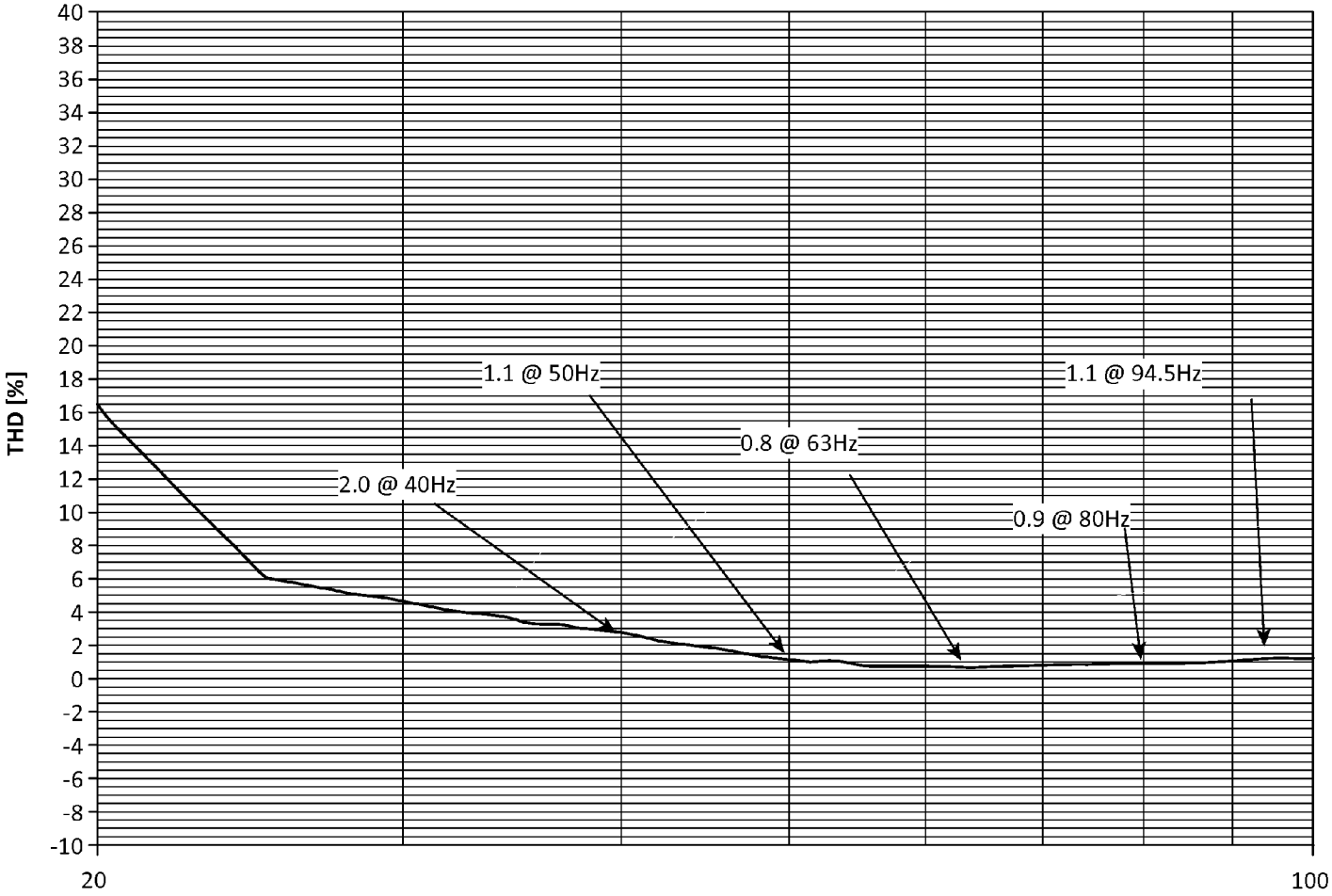
FIG. 9*f* is a graph of the THD response at the exit of an inverse horn enclosure, for the frequency response shown in FIG. 9*e*.

FIG. 9*f* is a graph of the THD for the above frequency response sweep in FIG. 9*e*, taken at the inverse horn exit from 10 to 100 Hz, with an input now of 2.83 v. At 40 Hz THD is 2% corresponding to 117 dB of output. At 50 Hz THD is only 1.1%, at 63 Hz only 0.80%, at 80 Hz, 0.90%, and at 94.5 Hz only 1.1%. Of interest here too are the frequencies from 63 Hz up, especially again that of 63 Hz itself. Once again this is the system resonance frequency of the enclosure, and virtually that of the transducer's $F_S$. THD at 63 Hz has remained very low even with over 5.5 times the amount of input, when such distortion would normally be much greater in a conventional design. As also seen in this graph those frequencies above 63 Hz out to 100 Hz remain relatively low in distortion as well. Once again, the filter chamber helps maintain low levels of distortion of both that of the system resonance frequency of the enclosure and a considerable amount of those frequencies and harmonics emanating from the exit.

Figure 9G:
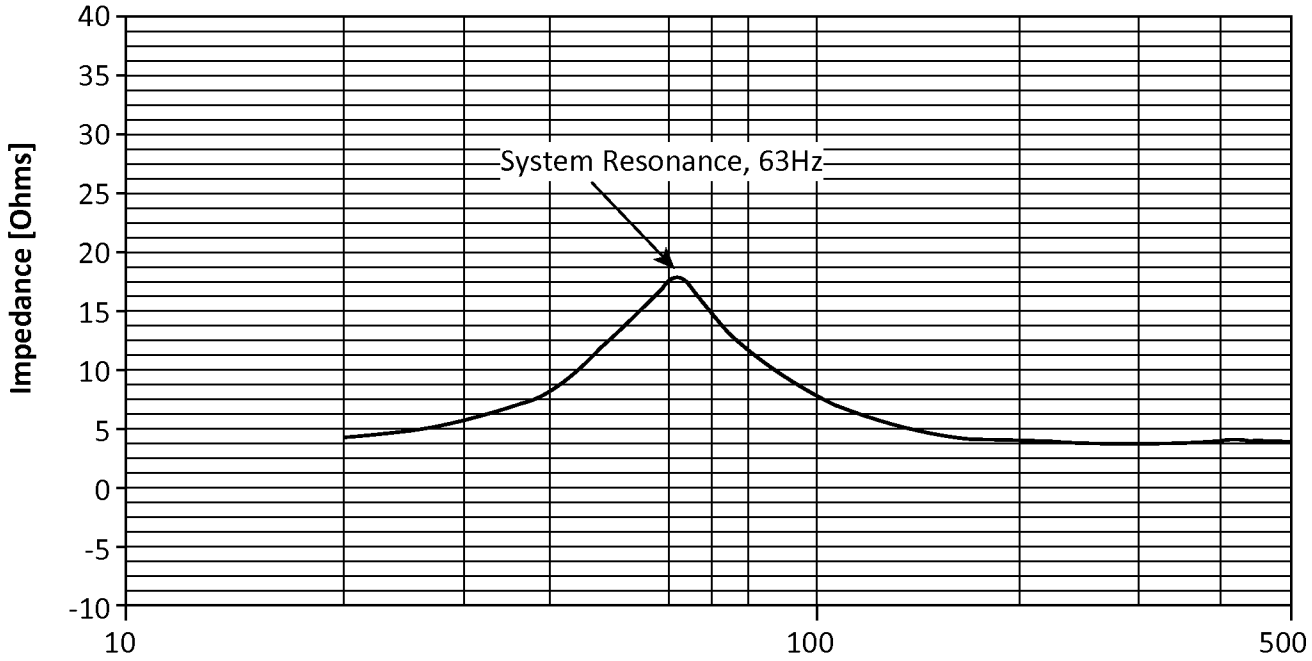
FIG. 9*g* shows system impedance with the inverse horn closed in a loudspeaker according to the configuration shown in FIG. 8.

FIG. 9*g* is a graph of the system resonance with the inverse horn exit 15 closed off. The single impedance peak is very indicative of a typical sealed and or acoustic air suspension loudspeaker design. Such resonance peak is virtually the same as when such impedance curve was taken with all the internal plates not present in the enclosure and the inverse horn exit was still sealed. This graph verifies that the air-flow through the enclosure is getting to all internal parts, even with all the internal plates in place as the air load in both cases is virtually the same. This helps establish that air-flow does get into filter chamber. The graph further establishes that the system resonance includes that in the inverse horn stages and is the same as that for the entire enclosure. Everything else being the same, such would not be the case without the area of the filter chamber being included in the enclosure. Without the filter chamber area, system resonance would be higher generally imposing greater difficulty to gain as low as an extended response with everything else being the same. This also verifies that the extended low bass frequency response achieved is well below that of the enclosure's natural sealed system resonance with the included transducer.

Figure 10:
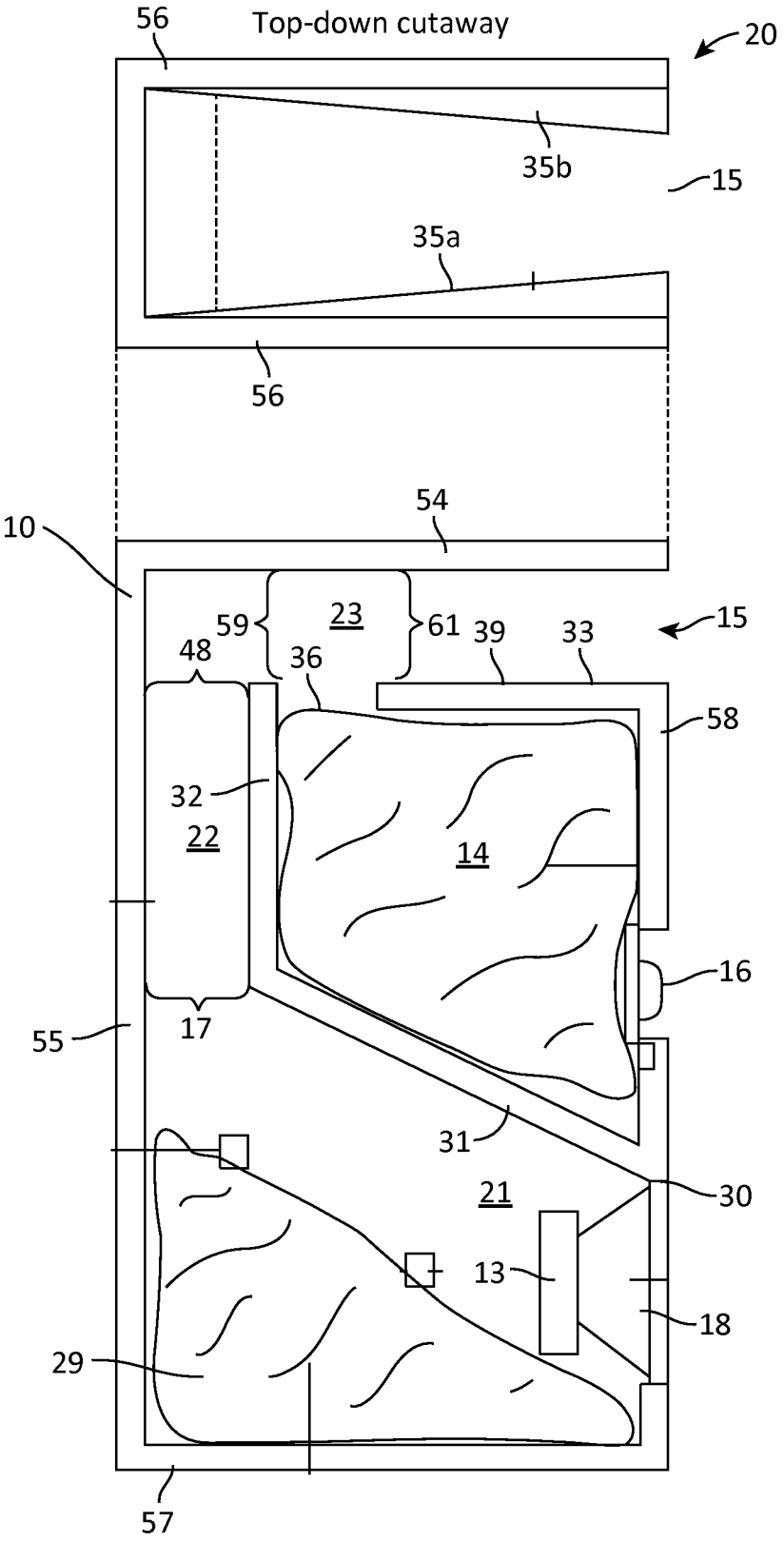
FIG. 10 illustrates another loudspeaker having multiple compression chambers.

FIG. 10 is a cross-sectional view of another example enclosure 10, having a bass driver transducer 13 and tweeter 16 with a front exit 15 for the inverse horn. In this example, the transducer 13 is a 5.25" in size with a piston radiating area of 14.1 square inches. The tweeter 16 is a 1" silk soft dome. The transducer's free-air resonance, $F_S$ is 63 Hz, and system resonance is 76 Hz. The Total Q, Qts, is 0.54. This embodiment of enclosure 10 has internal volume of about only 0.57 cu. ft., slightly more than V2 cu. ft.

The enclosure includes the top wall 54, back wall 55, bottom wall 57, and front baffle 58. Further included is a first horn plate 31, a second horn plate 32, and a third horn plate 33. The horn plates form three compression chambers 21, 22, 23, which are the decreasing flares of an inverse horn. The first compression chamber 21 is coupled to the rear radiating surface of the transducer 13. As the acoustic output from the rear of transducer 13 progresses through compression chamber 21, the dimensional area becomes reduced, compressing the air to the tightest point in compression chamber 21 at a first pressure area 17.

Horn plate 32 connects with horn plate 31 at pressure area 17, which is the end of horn plate 31 and compression chamber 21. Horn plate 32 then extends up the inside of the enclosure, parallel with the inside of back wall 55 until it reaches a given point in horizontal line with horn plate 33. This forms compression chamber 22, which has a constant compression through its length. Compression chamber 22 continues to maintain the same pressure created at pressure area 17 as the air-flow continues until it reaches its end at the top end of horn plate 32. This creates pressure area 48 between it and the inside back 55 of the enclosure, which has the same horn cross-sectional area as at pressure area 17.

At the top of horn plate 32 toward the top wall 54 of the enclosure 10 is also created pressure area 59, between the top end of horn plate 32 and the inside bottom of the top wall 54. Between the top end of horn plate 32 and the internal end of horn plate 39 is the entrance 36 into the filter chamber 14, which in this example has a slightly smaller cross-sectional area than pressure area 59. At the inner end of horn plate 39 is pressure area 61. This typically is 0.5-2% smaller than the cross-sectional area of pressure area 59. Such, again however, may vary somewhat outside this range. Horn plate 39 then continues to the front 58 of the enclosure 10 which is the inverse horn exit 15. This creates compression chamber 23, which in this example, continues to reduce in cross-sectional area by the two triangular shaped cleats 35*a* & 35*b*, all the way to the inverse horn exit 15 which, in this example, is 35% of the piston radiating area of the transducer.

Figure 11A:
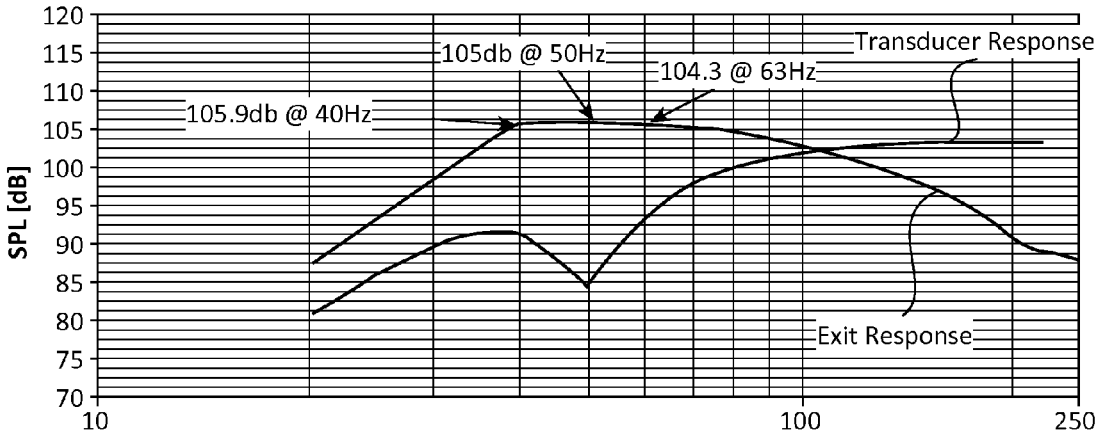
FIG. 11*a* is a graph depicting the frequency response of a loudspeaker according to the configuration shown in FIG. 10.
Figure 11B:
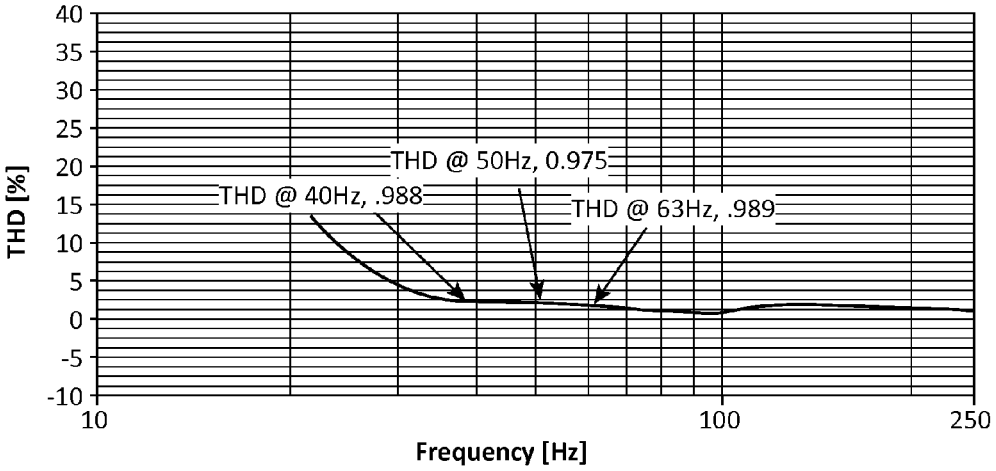
FIG. 11*b* is a graph of the THD of the FIG. 11*a* frequency response.

FIGS. 11*a* and 11*b* demonstrates the performance of the system illustrated in FIG. 10. First, FIG. 11*a* shows the frequency responses at 0.5 v input. As can be seen response from the inverse horn exit 15 is extended smoothly and flat to 40 Hz at 105.9 dB output at the exit. At 50 Hz the output is 105 dB and is 104.3 dB at 63 Hz. The −3 dB down frequency is 37 Hz. Note the rapid roll off rate at the extended cutoff frequency, a very indicative horn attribute. FIG. 11*b* shows the THD of the above frequency response sweep, with the same 0.5 v input, from 10 to 250 Hz. THD at 40 Hz is 0.9880, at 50 Hz 0.975% and at 63 Hz 0.989%, which is the $F_S$, free-air resonance of the transducer 13. At this frequency a conventional design would exhibit considerably higher distortion. The system resonance frequency is 76 Hz, which the graph shows having a THD around 0.950%, again quite low for this troublesome frequency, considering that the amplitude of which is in the 103 db range.

Figure 12:
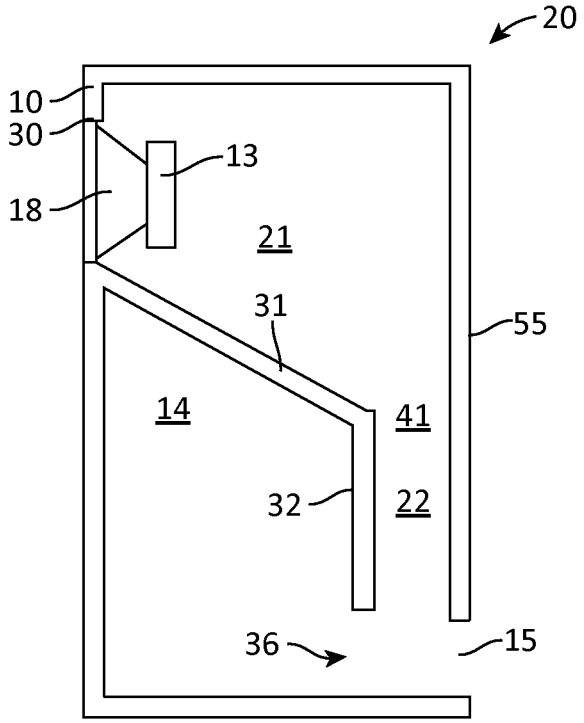
FIG. 12 illustrates a loudspeaker having two compression chambers.

FIG. 12 shows a rear exiting enclosure 10 with two compression chambers. Here, horn plate 32 extends straight down in the enclosure from the end of horn plate 31 to the entrance 36 of the filter chamber 14, which is an increased pressure area. Between horn plate 32 and the inside of the rear wall 55 of the enclosure 10 is compression chamber 22, with a constant cross sectional area which provides for the continued pressure achieved at the exit 41 of compression chamber 21. The compression rate is constant all the way through compression chamber 22. By comparison, simple extensions of a vent passage in conventional designs attempt to extend response starting at or below the transducer's $F_S$ and extending lower below system $F_S$, but in doing so lose significant amplitude. The result in conventional design would be a significant roll off of the bass frequencies below the $F_S$ of the transducer. However, in the present embodiment, the inverse horn enclosure 10 provides a lower extended frequency response, consequently allows for a smoother extended range to the horn cutoff, which can be well below the transducer's $F_S$. Increased pressure through compression chamber 22 is already established from the inverse horn loading with increased pressure at exit 41. Compression chamber 22 operates as a second-stage addition or extension of compression chamber 21 all the way to the inverse horn exit 15. Because of the inverse horn being a better acoustic transformer/coupler than a simple bass reflex port, low frequency bass response is extended with amplitude response and efficiency maintained.

Figure 13:
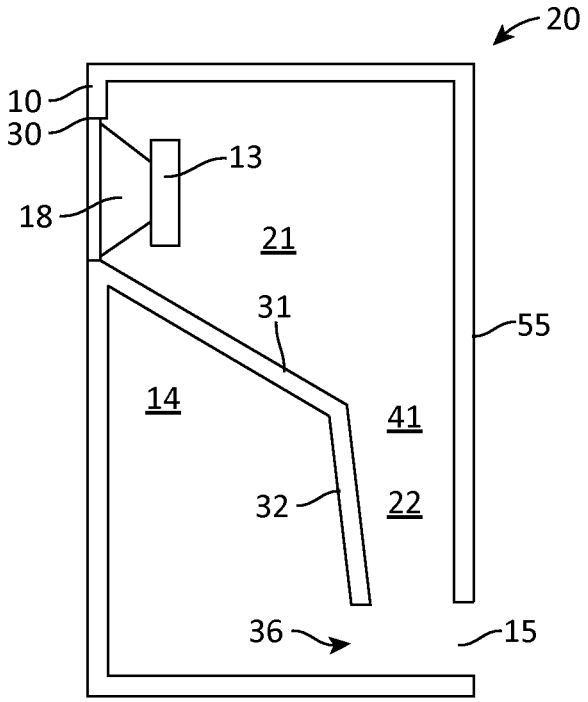
FIG. 13 illustrates another loudspeaker having two compression chambers.

FIG. 13 shows another rear exiting inverse horn enclosure 10 with two compression chambers. Here, horn plate 32 that starts at the end of horn plate 31 such that the extension creates compression chamber 22 which provides for continuous pressure from exit 41 through compression chamber 22. This continuing rate of compression acts to load the horn more efficiently, which can both extend the low bass response and/or increase output at a lower cutoff frequency, or both. Such extension of response and output increases can depend on horn length, rate of compression, transducer size and resonance, and enclosure size internally, any or all of which parameters can be altered to gain the extended range and/or output at cutoff desired. With the addition of horn plate 32 and compression chamber 22, the inverse horn now becomes a two-stage inverse horn with extended length and dual compression rates.

FIG. 1 and FIG. 2 also illustrate additional benefits of the three chamber system's greater capability due to more compression flexibility and control, and increased horn lengths. First, compression chamber 21 has been reduced in relative size. Second, the compression rate through compression chamber 21 is typically greater. Third, the filter chamber 14 has increased in relative size. These three chamber systems offer improved extension to lower frequencies, when compared to the two chamber systems of FIG. 12 and FIG. 13. Additional benefits of the three chamber systems are noted above with respect to FIGS. 1 and 2.

Figure 14:
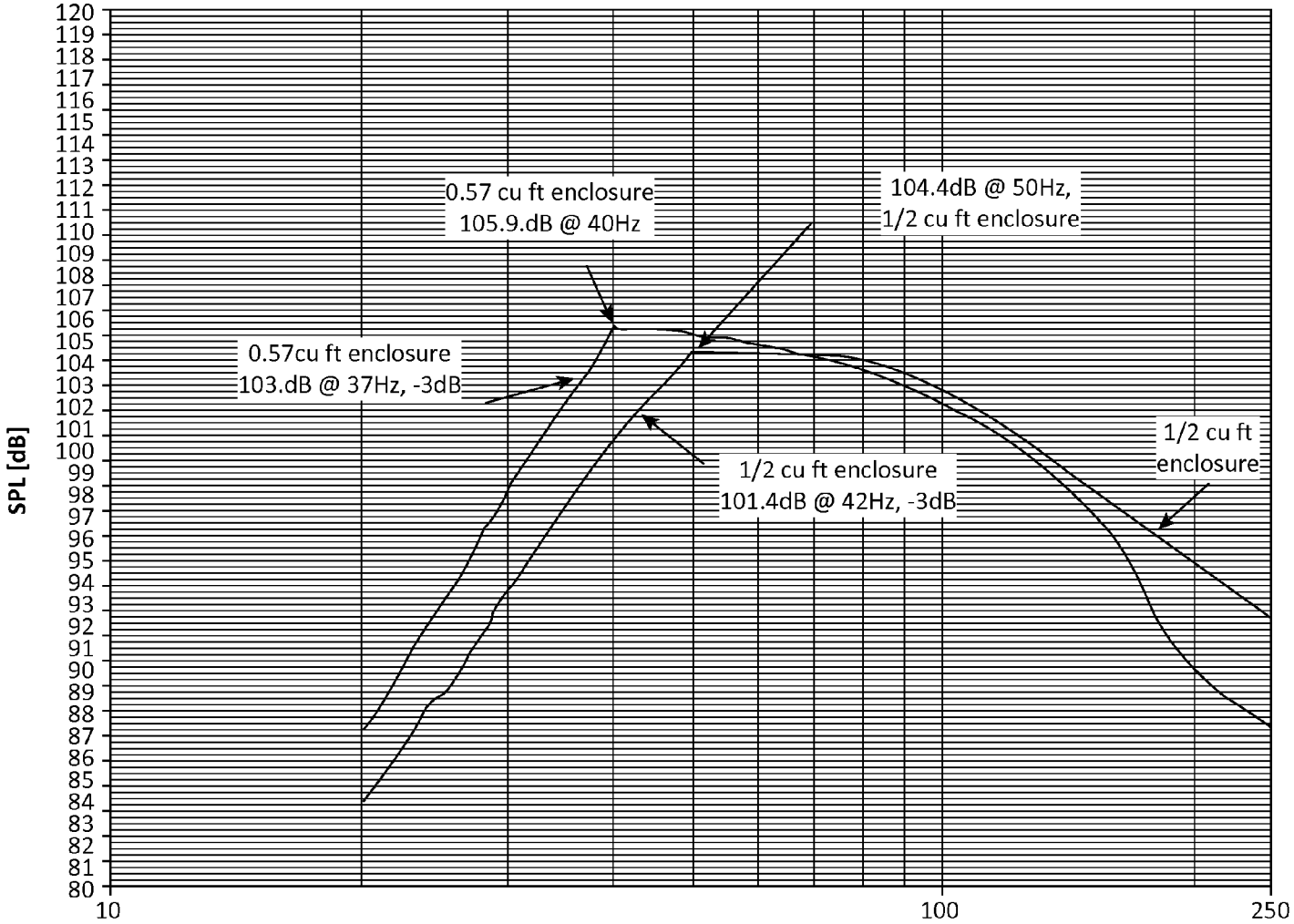
FIG. 14 is a graph of two frequency response curves of the exit overlaid, from an enclosure disclosed U.S. Pat. No. 4,373,606, and an embodiment of the present loudspeaker enclosure, using the same 5.25" woofer.

FIG. 14 is a graph of two frequency response curves taken at the exit of both a loudspeaker as disclosed in U.S. Pat. No. 4,373,606 (which is incorporated by reference herein) comprising 0.5 cu. ft enclosure and a 0.57 cu. ft. inverse horn enclosure system 10 such as shown in FIG. 10. The same 5.25" woofer was used in both, having a 63 Hz $F_S$. It is clearly seen that in the previous enclosure, the extended bass response was flat to 50 Hz with output of 104.4 dB and a −3 dB down point at 42 Hz, 0.5 v input. In an inverse horn enclosure system 10, with the same woofer, the frequency response was extended to 40 Hz flat with 105.9 dB of output and a −3 db down point of 37 Hz. The inverse horn enclosure system 10 extended the response almost half an octave lower with almost 2 dB higher output while having a 44% larger exit. Achieving these performance improvements with a 44% larger exit is believed to completely contrary to popular vented design principles that typically require smaller exits to extend response, and is thus indicative of the attributes of added horn length used in combination with multiple and higher compression rates, as used in the various embodiments. Further, the inverse horn enclosure system 10 is very similar in size to the previous design, with the inverse horn enclosure system 10 being only 1.1 times in size in volume. However, the inverse horn enclosure system 10 exhibits output of 105.9 dB at the exit given the same input of 0.5 v with less than 1% THD and flat in response to a substantially lower frequency than that of the previous design.

It is understood that many variations can be achieved in the enclosure within the principles of the invention. For example, the inverse horn's shape and/or rate of taper can vary in one or more horn stages or overall, one or all compression chambers and/or the horn's overall length or length of the individual sections could be changed, as well as the specific inverse horn exit location (on the cabinet's side, for example). Alternately, the compression chambers could be constructed as one continuous, curved inverse horn. The resulting enclosure performance measurements, with similar or smaller transducers and in similar or smaller size enclosures, clearly validate their initial performance capability.

Different size transducers with different electrical and acoustical parameters can be used, and many other numerous variations can be made. Additionally, the filter chamber can change in size, shape as well as its specific location of its opening, along with the use of multiple filter chambers, inverse horns, and transducers.

Two of the different embodiments of the inverse horn enclosure include one having a rear inverse horn exit, and the other having a front inverse horn exit, with some embodiments using two internal dividers in the rear exit enclosure design, and three internal dividers in the front vented enclosures.

As used herein, a front exit generally refers to the inverse horn exit being on the front of the enclosure, meaning, the same side of the enclosure as the transducer and facing towards the listener. A rear exit generally refers to the exit being on the back of the enclosure such that it is on the opposite or different side of the enclosure as the transducer, and facing away from the listener. In alternative embodiment, the exit output could be configured to exit from any side of the enclosure, or combination of sides of the enclosure.

Additional Design Considerations

In the structure of the inverse horn, better performance can been realized from avoiding 180 degree transitions between any two compression chambers, as resulting losses can reduce the inverse horn efficiency. This can be seen in the various embodiments in the figures.

The continuous pressure through the enclosure can be constant, or even slightly relaxed for a short distance in the enclosure. However, this can require further increased compression in the next in-line compression chamber or chambers, or continued compression from the previously greatest compression point, which continues to the inverse horn exit.

As discussed above, most low frequency horn/waveguide/pipe designs are typically based on ¼wave of the desired frequency. However, the line lengths of inverse horn can be considerably shorter than line lengths in conventional design to achieve extended low end cutoff $F_c$ while maintaining good efficiency and smooth amplitude response. Specifically, an inverse horn enclosure can have a very low tuning frequency while embodying much less than a ¼wavelength inverse horn length. Also, any wave effects developed in the inverse horn will tend to be well above the low frequency limit of the system and may be from higher frequency parasitic wave effects such as those of all odd quarter wavelengths. Those that are undesirable can be addressed by the filter chamber, which can be tuned to cancel or attenuate the most prominent effects of this type and by the use of the damping materials.

Driver or drivers $S_d$ or effective diaphragm surface area, is used to determine the ever-decreasing taper rate cross-sectional areas of the inverse horn. One aspect of that determination is that the inverse horn exit is always smaller than the piston radiating area of the driver, typically being 30%-70% of the driver $S_d$. However, in many cases, depending on cabinet size and driver size, can be as little as 20% and more than 80% of the driver $S_d$.

Typical drivers used in the inverse horn have a higher free air resonance $F_S$ (usually between 50 and 80 Hz), relative to those used in conventional design (typically being from 20 hz to 50 Hz), depending on the size of the enclosure and the desired extended low frequency cutoff and the output of such. Special applications may allow for lower $F_S$ drivers with acceptable results, but with some reduction in sensitivity and greater excursion rates below the system cut-off frequency or $F_b$.

The filter chamber provides additional benefits for the entire system. Without it, there is overall reduced air volume in the enclosure at frequencies below the tuning frequency $F_r$ of the filter chamber, resulted in raising system resonances and the low-frequency cut-off. Secondly, the filter chamber helps to reduce THD, as well as parasitic wave effects in the inverse horn.

The filter chamber opening placement can be placed at any point along the set of compression chambers that form the inverse horn, depending on what type of parasitic distortion is most dominate and is chosen to be minimized. The filter chamber opening can be most effective when placed closest to the strongest resistance positions in the line. Placed near the entrance or exit ends of the second compression chamber or at the entrance end of the third compression chamber offer some additional benefits. Both such placements tend to exhibit the smoothest, continuous roll off of unwanted upper frequencies emanating from the vent opening, and reduce amplitude peaks of any residual reinforcement of any such frequencies.

Any expanding sections of the compression chambers throughout the inverse horn should be minimized or avoided, as this is counter-productive to creating the compression required to maximize performance. Any point after the first compression chamber should not have any compression chamber wherein the entrance opening of one chamber is larger than the exit opening of a previous chamber.

Damping material in the compression chambers after the first compression chamber should be avoided. Small amounts could be used in special cases to minimize standing waves or resonances, but it is preferred to have all compression chambers past the first compression chamber to be void of all damping material, with design preference being for minimum resistive losses in the inverse horn after the first compression chamber to the exit of the inverse horn into the external environment.

An additional advantage of the inverse horn design is that of inherent cabinet bracing. Typically, enclosures must have very thick and dense cabinet walls to avoid cabinet wall resonances, which add to weight and expense. Due to the inherent bracing from the application of multiple compression chambers and the filter chamber, the inverse horn enclosure can use much thinner and lighter materials and avoid problematic cabinet wall flexing and resonances that plague other design types. Given the same thickness of the enclosure wall material, an additional benefit is that the extra cross bracing from the internal horn plates simply reduces unwanted peripheral wall vibrations again providing for purer tone and overall cleaner sound.

As stated previously, an advantage of the inverse horn enclosure is to have the $F_S$ of the driver being greater than the low frequency cut-off of the system or above $F_b$. It is preferred that the free air resonance of the driver, $F_S$, is at least 12% above $F_b$. In some embodiments it would be preferable to have it be at least 25% above $F_b$ or the cut-off frequency of the system. The system $F_b$ can be determined by viewing the impedance curve of the system wherein the fundamental tuning frequency $F_b$ corresponds to a first impedance minimum frequency located above a lowest frequency impedance peak.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

The invention claimed is:

1. A loudspeaker system, comprising:

at least one first electro-acoustical transducer mounted in a transducer opening on the loudspeaker enclosure, the first electro-acoustical transducer comprising a moveable diaphragm for converting an electrical input signal into a corresponding acoustic output having pressure;

at least one inverse horn structure, comprising:

at least one second electro-acoustical transducer mounted in a transducer opening on the horn enclosure, the second electro-acoustical transducer comprising a moveable diaphragm for converting an electrical input signal into a corresponding acoustic output having a pressure;

a first compression chamber enclosing a rear side of the second transducer, a first internal volume that receives the acoustic output from the diaphragm, and a first exit comprising a first cross sectional area;

a second compression chamber comprising a second entrance and a second exit comprising a second cross sectional area, the second entrance directly acoustically connected to the first exit of the first compression chamber, and the second cross sectional area being smaller than or equal to the first cross sectional area;

a third compression chamber comprising a third entrance and a third exit comprising a third cross sectional area, the third entrance directly acoustically connected to the second exit of the second compression chamber, the third cross sectional area being smaller than or equal to the second cross sectional area;

wherein at least one of the compression chambers has a substantially constant cross sectional area from its entrance to its exit, and wherein any compression chambers placed immediately before or after a compression chamber with substantially constant cross sectional area has a reduction in cross sectional area from its entrance to its exit; and a last exit acoustically coupled to an exit of one of the compression chambers, the last exit acoustically coupled to an external environment.

2. The loudspeaker system of claim 1, further comprising at least one resonance-distortion filter chamber, each filter chamber comprising a filter chamber internal volume and a filter chamber opening acoustically connecting the filter chamber to one of the compression chambers, the filter chamber having a resonant tuning frequency $F_r$, wherein $F_r$ is a function of an acoustical compliance of the filter chamber internal volume and an acoustical mass located at the filter chamber opening.

3. The loudspeaker system of claim 2, wherein at least a portion of at least one filter chamber is filled with acoustic damping material.

4. The loudspeaker system of claim 2, wherein the resonant tuning frequency $F_r$ is higher than a fundamental tuning frequency $F_b$ that corresponds to a first minimum impedance frequency in an impedance curve of the loudspeaker system, the first minimum impedance frequency located above a lowest frequency impedance peak in the impedance curve.

5. The loudspeaker system of claim 1, wherein each compression chamber of each inverse horn structure exhibits acoustical compression that is different from every other compression chamber of that inverse horn structure.

6. The loudspeaker system of claim 1, further comprising:

a fourth compression chamber comprising a fourth entrance and a fourth exit with a fourth cross sectional area, the fourth entrance directly acoustically connected to the third exit of the third compression chamber, the fourth cross sectional area being smaller than or equal to the third cross sectional area.

7. The loudspeaker system of claim 1, wherein the at least one inverse horn structure includes at least two inverse horn structures.

8. The loudspeaker system of claim 1, wherein the at least one first electro-acoustical transducer includes at least two electro-acoustical transducers.

9. The loudspeaker system of claim 1, wherein the last exit comprises a flare to reduce acoustic turbulence.

10. The loudspeaker system of claim 1, wherein:

the second compression chamber tapers from the second entrance to the second exit; and the third compression chamber has a substantially constant cross sectional area from the third entrance to the third exit.

11. The loudspeaker system of claim 1, wherein the second and third compression chambers are free from acoustically resistant damping material.

12. A loudspeaker system, comprising:

at least one electro-acoustical transducer mounted in a transducer opening on the loudspeaker enclosure, the electro-acoustical transducer comprising a moveable diaphragm for converting an electrical input signal into a corresponding acoustic output having pressure;

at least one inverse horn structure, comprising:

at least one electro-acoustical transducer mounted in a transducer opening on the horn enclosure, the electro-acoustical transducer comprising a moveable diaphragm for converting an electrical input signal into a corresponding acoustic output having a pressure;

a first compression chamber comprising the transducer, a first internal volume that receives the acoustic output from the diaphragm, and a first exit comprising a first cross sectional area;

a second compression chamber comprising a second entrance and a second exit comprising a second cross sectional area, the second entrance directly acoustically connected to the first exit of the first compression chamber, wherein the second compression chamber tapers from the second entrance to the second exit;

a third compression chamber comprising a third entrance and a third exit comprising a third cross sectional area, the third entrance directly acoustically connected to the second exit of the second compression chamber, wherein the third compression chamber has a substantially constant cross sectional area from the third entrance to the third exit; and a last exit acoustically coupled to an exit of one of the compression chambers, the last exit acoustically coupled to an external environment.

13. The loudspeaker system of claim 12, further comprising:

at least one filter chamber comprising a filter chamber internal volume and a filter chamber opening acoustically connecting the filter chamber to one of the compression chambers, the filter chamber having a resonant tuning frequency $F_r$, wherein $F_r$ is determined by an acoustical compliance of the filter internal volume and an acoustical mass located at the filter chamber opening.

14. The loudspeaker system of claim 13, wherein the at least one filter chamber includes at least two filter chambers, the at least two filter chambers acoustically connected to a single inverse horn structure.

15. The loudspeaker system of claim 13, wherein at least a portion of at least one filter chamber is filled with acoustic damping material.

16. The loudspeaker system of claim 13, wherein the resonant tuning frequency $F_r$ is higher than a fundamental tuning frequency $F_b$ that corresponds to a first minimum impedance frequency in an impedance curve of the loudspeaker system, the first minimum impedance frequency located above a lowest frequency impedance peak in the impedance curve.

17. The loudspeaker system of claim 12, wherein each compression chamber of each inverse horn structure exhibits acoustical compression that is different from every other compression chamber of that inverse horn structure.

18. The loudspeaker system of claim 12, wherein at least one of the compression chambers has a substantially constant cross sectional area from its entrance to its exit, and where any compression chambers placed immediately before or after a compression chamber with substantially constant cross sectional area has a reduction in cross sectional area from its entrance to its exit.

19. The loudspeaker system of claim 12, further comprising:

a fourth compression chamber comprising a fourth entrance and a fourth exit with a fourth cross sectional area, the fourth entrance directly acoustically connected to the third exit of the third compression chamber, the fourth cross sectional area being smaller than or equal to the third cross sectional area.

20. The loudspeaker system of claim 12, wherein the at least one inverse horn structure includes at least two inverse horn structures.

21. The loudspeaker system of claim 12, wherein the at least one electro-acoustical transducer includes at least two electro-acoustical transducers.

22. The loudspeaker system of claim 12, wherein the last exit comprises a flare to reduce acoustic turbulence.

23. The loudspeaker system of claim 12, wherein the second and third compression chambers are free from acoustically resistant damping material.

24. The loudspeaker system of claim 2, wherein the at least one filter chamber includes at least two filter chambers, the at least two filter chambers acoustically connected to a single inverse horn structure.

* * * * *